US007359069B2

(12) United States Patent
Tanaka et al.

(10) Patent No.: US 7,359,069 B2
(45) Date of Patent: Apr. 15, 2008

(54) POLISHING PAD SURFACE SHAPE MEASURING INSTRUMENT, METHOD OF USING POLISHING PAD SURFACE SHAPE MEASURING INSTRUMENT, METHOD OF MEASURING APEX ANGLE OF CONE OF POLISHING PAD, METHOD OF MEASURING DEPTH OF GROOVE OF POLISHING PAD, CMP POLISHER, AND METHOD OF MANUFACTURING SEMICONDUCTOR DEVICE

(75) Inventors: Toshihisa Tanaka, Yokohama (JP); Atsushi Tanaka, Fuchu (JP); Takeshi Soma, Saitamaken (JP)

(73) Assignees: Nikon Corporation, Tokyo (JP); Ebara Corporation, Tokyo (JP)

( * ) Notice: Subject to any disclaimer, the term of this patent is extended or adjusted under 35 U.S.C. 154(b) by 0 days.

(21) Appl. No.: 11/492,933

(22) Filed: Jul. 26, 2006

(65) Prior Publication Data

US 2006/0260745 A1 Nov. 23, 2006

Related U.S. Application Data

(63) Continuation of application No. PCT/JP2005/000935, filed on Jan. 19, 2005.

(30) Foreign Application Priority Data

Jan. 28, 2004 (JP) ..... 2004-019215

(51) Int. Cl.
*G01B 11/06* (2006.01)

(52) U.S. Cl. ..... 356/630; 438/14; 451/5; 451/41

(58) Field of Classification Search ..... 356/630–632; 451/5, 287, 41, 288; 30/553, 554; 438/14, 438/692

See application file for complete search history.

(56) References Cited

U.S. PATENT DOCUMENTS

| | | | | |
|---|---|---|---|---|
| 5,777,739 | A * | 7/1998 | Sandhu et al. | 356/503 |
| 6,390,903 | B1 * | 5/2002 | Takahashi et al. | 451/286 |
| 7,070,479 | B2 * | 7/2006 | Faustmann et al. | 451/21 |
| 2004/0203328 | A1 * | 10/2004 | Tada et al. | 451/285 |

* cited by examiner

*Primary Examiner*—Hoa Q. Pham
(74) *Attorney, Agent, or Firm*—Morgan, Lewis & Bockius LLP

(57) ABSTRACT

The main sensor 15 measures the distance Lm to the surface of the pad 2*a*, and the sub-sensor 16 measures the distance Ls to the surface of the reference block 12. What is actually taken as the measured value is the value of (Lm+Ls). The reference block 12 is used in order to give a reference position for measuring the surface position of the pad 2*a*. Accordingly, correct measurements can be performed even if the position of the movable element 9 should fluctuate, for example, as a result of deformation of the guiding and holding plate 7 or guide 8. When the motor 11 is caused to rotate, the ball screw 10 rotates, so that the movable element 9 moves leftward and rightward, and the distance to the pad 2*a* is measured. From the measured data of this distance, the circular-conical vertical angle, groove depth, thickness, and the like of the pad 2*a* are determined.

12 Claims, 19 Drawing Sheets

POLISHING PAD SURFACE SHAPE MEASURING INSTRUMENT, METHOD OF USING POLISHING PAD SURFACE SHAPE MEASURING INSTRUMENT, METHOD OF MEASURING APEX ANGLE OF CONE OF POLISHING PAD, METHOD OF MEASURING DEPTH OF GROOVE OF POLISHING PAD, CMP POLISHER, AND METHOD OF MANUFACTURING SEMICONDUCTOR DEVICE

This is a continuation from PCT International Application No. PCT/JP2005/000935 filed on Jan. 19, 2005, which is hereby incorporated by reference.

TECHNICAL FIELD

The present invention relates to a surface shape measuring device for a polishing pad used in a CMP polishing apparatus or the like, a method of use for this polishing pad surface shape measuring device, a polishing pad circular-conical vertical angle measurement method, a polishing pad groove depth measurement method, a CMP polishing apparatus, and a semiconductor device manufacturing method.

BACKGROUND ART

As semiconductor integrated circuits have become finer and more highly integrated, the steps involved in semiconductor manufacturing processes have increased in number and become more complicated. As a result, the surface state of a semiconductor device is no longer necessarily flat. The presence of steps on such surfaces leads to the breakage of wiring by steps, an increase in local resistance values, and the like, thus resulting in loss of wire connections, a drop in current capacity, and the like. Furthermore, this also leads to a deterioration in the withstand voltage and the occurrence of leaks in insulating films.

Meanwhile, as semiconductor integrated circuits have become finer and more highly integrated, the light source wavelength used in photolithography has become shorter, and the numerical aperture, or so-called NA, has become larger. Consequently, the focal depth of semiconductor exposure apparatuses has become substantially shallower. In order to handle such an increased shallowness of the focal depth, a flattening of device surfaces to a degree exceeding that seen in the past is required.

A technique known as chemical mechanical polishing or chemical mechanical planarization (hereafter abbreviated to "CMP") has been widely used as a method for such flattening of the surfaces of semiconductor devices. Currently, this CMP technique is the only method capable of flattening the entire surface of a silicon wafer.

CMP was developed on the basis of a mirror surface polishing method for silicon wafers, and is performed using a CMP apparatus such as that shown in FIG. 18. 65 indicates a head part which applies rotation while holding a wafer 66 that constitutes the object of polishing. This head part 65 has a rotational driving mechanism 67. A rotating platen 69 to which a polishing pad 68 is bonded, and a rotational driving mechanism 70 for this rotating platen 69, are disposed facing this head part 65. The polishing pad 68, rotating platen 69 and rotational driving mechanism 70 are given a swinging motion by a rotating type swinging arm 71, and are driven upward and downward.

When polishing is performed using such a CMP polishing apparatus, the wafer 66 and polishing pad 68 are caused to rotate at a high speed, and the rotating type swinging arm 71 is lowered by a raising-and-lowering driving mechanism not shown in the figure, so that the wafer 66 is pressed by the polishing pad 68. Furthermore, a slurry constituting a polishing agent is supplied between the polishing pad 68 and wafer 66. Moreover, the rotating type swinging arm 71 is caused to swing as indicated by the broken-line arrow by a swinging driving mechanism not shown in the figure. Consequently, as a result of the relative rotation and swinging of the polishing pad 68 and wafer 66, polishing of the wafer 66 is performed so that the surface of the wafer 66 is flattened. Specifically, favorable polishing is accomplished by a synergistic effect of mechanical polishing by the relative motion of the polishing pad 68 and wafer 66 and chemical polishing by the slurry.

In such a CMP polishing apparatus, the polishing pad 68 also becomes worn as the wafer 66 is polished. Accordingly, it is necessary to measure the surface shape and wear (reduction in thickness) of the polishing pad 68, and the reduction in the depth of the grooves formed in the polishing pad 68, and to perform polishing (dressing) of the polishing pad 68 itself, or to replace the polishing pad 68.

FIG. 19 shows the internal construction of the polishing chamber in a conventional CMP apparatus. A polishing station 42, a dressing station 43 and a pad replacement station 44 are disposed inside this polishing chamber 41.

The polishing pad 48 held on a rotating type swinging arm 46 is arranged so that this polishing pad 48 can be positioned on top of the polishing station 42, dressing station 43, pad replacement station 44, and the like by the rotation of the rotating type swinging arm 46.

When a specified number of wafer polishing passes has been completed, the rotating type swinging arm 46 shifts the polishing pad 48 from the polishing station 42 to the dressing station 43, and dressing of the polishing pad 48 is performed. After dressing is completed, the polishing pad 48 is removed, and the shape is measured by a measuring device not shown in the figure; then, the polishing pad 48 is again attached to the rotating platen, and if the measurement results are favorable, the polishing pad 48 is used "as is" in polishing. In cases where the shape is not favorable, dressing is performed again. Thus, conventionally, there has been no means for observing the surface of the polishing pad inside the CMP apparatus, so that the shape is measured after first temporarily removing the polishing pad from the polishing chamber.

However, removing the polishing pad from the rotating type swinging arm every time that the shape of the polishing pad is to be measured requires the expenditure of considerable effort; consequently, not only is the throughput lowered, but when he polishing pad is again mounted on the rotating platen, the mounted state differs from that prior to the removal of the polishing pad. As a result, distortion is newly generated, so that the flatness deteriorates, and there may be cases in which the desired polishing cannot be performed.

DISCLOSURE OF THE INVENTION

The present invention was devised in light of the above circumstances; it is an object of the present invention to provide a polishing pad surface shape measuring device which can be disposed inside the main body of a CMP polishing apparatus, and which makes it possible to perform measurements without removing the polishing pad, a method of use of this polishing pad surface shape measuring device, a polishing pad circular-conical vertical angle measurement method, a polishing pad groove depth measurement method, a CMP polishing apparatus equipped with the polishing pad surface shape measuring device, and a semiconductor device manufacturing method using this CMP polishing apparatus.

The first invention that is used to achieve the object described above is a polishing pad surface shape measuring device comprising a first detector which measures the distance to the surface of the polishing pad, a second detector which measures the distance to the surface of a reference member that has a standard degree of flatness, a movable element which slides along a guide mechanism, and which carries the first detector and the second detector, a driving part which drives the movable element in the direction of diameter of the polishing pad, position detection means for detecting the position of the movable element in the direction of diameter of the polishing pad, and measurement means for measuring at least one value selected from a set consisting of the circular-conical vertical angle formed by the polishing pad surface, the groove depth and the pad thickness, using the distance output from the first detector, the distance output from the second detector and the output of the position of the movable element in the direction of diameter of the polishing pad, wherein at least one end of the reference member is held by a mechanism that allows displacement of the movable element in the driving direction and bending in this direction.

In the present invention, as a result of the distance from the reference plane to the polishing pad being measured, at least one value selected from a set consisting of the circular-conical vertical angle formed by the polishing pad surface, the groove depth and the pad thickness can be automatically measured on the basis of this measurement result.

Since at least one end of the reference member is held by a mechanism that allows displacement of the movable element in the driving direction and bending in this direction, deformation or vibration tends not to be transmitted to the reference member even in cases where members to which the reference member is attached undergo deformation especially because of the effects of temperature variation, or are subjected to vibration, so that the reference precision of measurement can be maintained.

The second invention that is used to achieve the object described above is the first invention, wherein the device has a waterproof cover that accommodates at least the first detector, the second detector, the reference member, the guide mechanism, the movable element, a portion of the driving part, and the position detection means, a window part that is used to observe the polishing pad is formed in this waterproof cover, and a mechanism for opening and closing this window part is provided.

In this invention, there is little contamination of the essential parts of the measuring part by the polishing liquid and cleaning liquid. Furthermore, since it is sufficient to perform measurements by opening the window only at the time of measurement, contamination can be further prevented.

The third invention that is used to achieve the object described above is a polishing pad surface shape measuring device comprising a measuring element which can contact the polishing pad, a first detector which measures the distance to the polishing pad surface or the distance to the measuring element in a non-contact manner, a second detector which measures the distance to the surface of a reference member that has a standard degree of flatness, a movable element which slides along a guide mechanism, and which carries the measuring element, first detector and second detector, a driving part which drives the movable element in the direction of diameter of the polishing pad, position detection means for detecting the position of the movable element in the direction of diameter of the polishing pad, means for switching between a state in which the distance to the measuring element is measured by the first detector in a state in which the measuring element is caused to contact the polishing pad, and a state in which the distance to the surface of the polishing pad is measured by the first detector in a state in which the measuring element is separated from the polishing pad, and measurement means for measuring at least one value selected from a set consisting of the circular-conical vertical angle formed by the polishing pad surface, the groove depth and the pad thickness, using the distance output from the first detector, the distance output from the second detector, and the output of the position of the movable element in the direction of diameter of the polishing pad.

In the present means, it is possible to switch between a method in which the surface shape of the polishing pad is measured by causing the measuring element to contact the polishing pad, and measuring this position by means of the first detector, and a method in which the surface shape of the polishing pad is measured directly by means of the first detector. Accordingly, the surface shape of the polishing pad can be accurately measured using special features of the two methods to good advantage.

Specifically, in cases where there is a possibility that nap on the surface of the polishing pad will have an effect on the measurement precision, the circular-conical vertical angle of the polishing pad or the thickness of the polishing pad can be measured in a state in which nap has little effect, by measuring the surface shape of the polishing pad by means of the measuring element. In a state in which nap has no effect on the measurement precision, non-contact measurement can be performed by measuring the surface shape of the polishing pad directly with the first detector. Furthermore, the groove depth can be determined by measuring the surface shape of the polishing pad directly with the first detector.

The fourth invention that is used to achieve the object described above is the third invention, wherein at least one end of the reference member is held by a mechanism that allows displacement in the driving direction of the movable element, and bending in this direction.

In this means, the reference member is held at at least one end by a mechanism that allows displacement in the driving direction of the movable element, and bending in this direction; accordingly, even in cases where members to which the reference member is attached undergo deformation because of the effects of temperature variation, and in cases where these members are subjected to vibration, such deformation and vibration tend not to be transmitted to the reference member, so that the reference system of measurement can be maintained.

The fifth invention that is used to achieve the object described above is the third invention or fourth invention, wherein the device has a waterproof cover that accommodates at least the first detector, the second detector, the measuring element, the reference member, the guide mechanism, the movable element, a portion of the driving part, and the position detection means, a window part that is used to observe the polishing pad is formed in this waterproof cover, and a mechanism for opening and closing this window part is provided.

In this invention, the contamination of the essential parts of the measuring part by the polishing liquid and cleaning liquid is reduced, and since it is sufficient to perform measurements by opening the window only at the time of measurement, contamination can be further prevented.

The sixth invention that is used to achieve the object described above is any of the first through fifth inventions, wherein the first detector is an optical distance detector.

In this invention, since an optical type detector is used as the first detector, extremely small portions to be measured can be inspected with a high degree of precision. Accordingly, even in cases where grooves are formed in the surface, the distance to the interior portions of these grooves can also be measured.

The seventh invention that is used to achieve the object described above is the sixth invention; wherein the system has a device that blows a gas through the light projecting part and light receiving part of the first detector.

In this invention, since a gas can be blown through the light projector and light receiver, the contamination of these optical systems by the polishing liquid and cleaning liquid can be reduced.

The eighth invention that is used to achieve the object described above is any of the first through seventh inventions, wherein the system has a device that blows a gas over the measurement location on the surface of the polishing pad during measurement.

In this invention, a gas is blown over the measurement location on the surface of the polishing pad; accordingly, even in cases where the polishing liquid or cleaning liquid remains on the surface of the polishing pad, these liquids can be blown away, so that accurate measurements can be performed.

The ninth invention that is used to achieve the object described above is any of the first through eighth inventions, wherein the system has an inclination detector that detects the inclination of the movable element with respect to the reference member, and the measurement means has the function of correcting the distance output from the first detector and the distance output from the second detector using the output from the inclination detector.

When the movable element tilts, a corresponding error is generated in the measured distance. In the present invention, a distance correction is performed on the basis of the output of an inclination detector that detects the inclination of the movable element with respect to the reference member; accordingly, even if the movable element tilts, the generation of error can be suppressed.

The tenth invention that is used to achieve the object described above is any of the first through ninth inventions, wherein the system has a temperature detector for the guide mechanism, and the measurement means has the function of correcting the measured value of the circular-conical vertical angle using the output of this temperature detector.

In this invention, since the determined value of the circular-conical vertical angle is corrected by means of the output of the temperature detector for the guide mechanism, even if error is generated by flexing of the guide mechanism or the like caused by the bimetal effect, this error is corrected, so that accurate measurements can be performed.

The eleventh invention that is used to achieve the object described above is any of the first through tenth inventions, wherein the reference member is held by this polishing pad surface shape measuring device, with one end being held by an elastic body that allows displacement with one degree of freedom, and the other end being held by an elastic body that allows displacement with two degrees of freedom, thus reducing the elongation of the reference member in the driving direction of the movable element and the bending retention rigidity in this direction.

In the present invention, the reference member is held by a retaining member that allows displacement with a total of three degrees of freedom; accordingly, the deformation that occurs in the reference member can be alleviated even in cases where deformation should occur in other members.

The twelfth invention that is used to achieve the object described above is a polishing pad surface shape measuring device comprising a measuring element which can contact the polishing pad, a first detector which measures the distance to the polishing pad surface or the distance to the measuring element in a non-contact manner, and means for switching between a state in which the distance to the measuring element is measured by the first detector in a state in which the measuring element is caused to contact the polishing pad, and a state in which the distance to the surface of the polishing pad is measured by the first detector in a state in which the measuring element is separated from the polishing pad.

In this means, it is possible to switch between a method in which the measuring element is caused to contact the polishing pad, and the surface shape of the polishing pad is measured by measuring this position by means of the first detector, and a method in which the surface shape of the polishing pad is measured directly by means of the first detector. Accordingly, the special features of both methods can be used to good advantage, so that the surface shape of the polishing pad can be accurately measured.

Specifically, in cases where there is a possibility that nap on the surface of the polishing pad will have an effect on the measurement precision, the circular-conical vertical angle of the polishing pad or the polishing pad thickness can be measured in a state in which such nap has little effect, by measuring the surface shape of the polishing pad by means of the measuring element. In a state in which nap has no effect on the measurement precision, non-contact measurement can be performed by measuring the surface shape of the polishing pad directly by means of the first detector. Furthermore, the groove depth can be determined by measuring the surface shape of the polishing pad directly by means of the first detector.

The thirteenth invention that is used to achieve the object described above is characterized in that a plurality of circular-conical vertical angles are determined using the polishing pad surface shape measuring device according to any of the first through twelfth inventions by rotating the polishing pad and performing measurements in respective rotational positions, and the dressing position of the polishing pad is determined on the basis of a value obtained by the statistical processing of these measured angles.

In this invention, the system is devised so that measurements are performed at a specified pitch along the entire circumferential direction, and the dressing position of the polishing pad is determined on the basis of a value obtained by the statistical processing of these measured values (e.g., the mean value); accordingly, the polishing pad as a whole can be dressed to an appropriate shape.

The fourteenth invention that is used to achieve the object described above is characterized in that a plurality of values for the groove depths are determined using the polishing pad surface shape measuring device according to any of the first through twelfth inventions by rotating the polishing pad and performing measurements in respective rotational positions, and replacement of the polishing pad is performed on the basis of a value determined by the statistical processing of these measured values.

In this invention, the system is devised so that measurements are performed at a specified pitch along the entire circumferential direction, a plurality of values for the groove depths are determined on the basis of a value obtained by the statistical processing of these measured values (e.g., the mean value), and replacement of the polishing pad is performed on the basis of this mean value; accordingly, the polishing pad can be replaced at an appropriate time.

The fifteenth invention that is used to achieve the object described above is characterized in that a plurality of values for the polishing pad thicknesses are measured using the polishing pad surface shape measuring device according to any of the first through twelfth inventions by rotating the polishing pad and performing measurements in respective rotational positions, and replacement of the conditioner of the dressing device is performed on the basis of a value obtained by the statistical processing of these polishing pad thickness values (e.g., the mean value).

In this invention, the thickness of the polishing pad as a whole is determined, and (for example) if there is no great change in the thickness from the time of the previous dressing, the conditioner of the dressing device can be replaced on the grounds that this conditioner has deteriorated. Accordingly, the replacement of the pad conditioner can be performed at an appropriate time.

The sixteenth invention that is used to achieve the object described above is a method for measuring the circular-conical vertical angle of the polishing pad in which the distance from a reference plane to the surface of the polishing pad is measured along a straight line or curved line passing through the vicinity of the center of the polishing pad, two straight lines indicating the surface of the polishing pad on both sides of the center of the polishing pad are determined by regression calculations from data at the effective polishing surface of the polishing pad, and the circular-conical vertical angle of the polishing pad is determined from the intersection of these two straight lines, wherein this method has a step which is such that in the determination of the respective straight lines, a line of regression and standard deviation are first determined by performing regression calculations using data within a specified distance range from either the maximum value, minimum value or mean value of the data used to determine one of the straight lines, an operation in which a new line of regression and new standard deviation are determined by performing regression calculations using data up to data that is distant from the line of regression by a value obtained by multiplying the standard deviation by a coefficient is then performed at least two times, or is repeated until the new standard deviation drops to a value that is equal to or less than a specified value, and the line of regression when a specified number of passes of this measurement operation have elapsed, or when the new standard deviation has dropped to a value that is equal to or less than this specified value, is taken as the one straight line mentioned above.

Since data relating to the groove parts is also included in the measured data besides data relating to the surface of the pad, it is necessary to exclude this data relating to the groove parts in order to achieve an accurate measurement of the surface shape. However, it is difficult to discriminate directly from the data which parts are groove parts and which parts are surface parts. Accordingly, in the present invention, the determination of a line of regression is performed repeatedly, and in this case, data that is separated to some extent from the determined line of regression is excluded, so that a new line of regression is determined from the remaining data. If this is done, data relating to the groove parts which are points of difference is successively excluded, so that a line of regression expressing an accurate surface shape is determined. Moreover, the circular-conical vertical angle is determined on the basis of this accurate line of regression.

Furthermore, if the specified number of times is set close to an infinitely large number of times, repetition until the new standard deviation drops to a value that is equal to or less than a specified value becomes the only condition, while if the specified value of the standard deviation is set close to zero, then repetition for the specified number of times essentially becomes the only condition. Accordingly, the present invention also includes systems in which a determination is made using only one of these conditions.

The seventeenth invention that is used to achieve the object described above is a method for measuring the depth of grooves formed in the polishing pad from data at the effective polishing surface of the polishing pad by measuring the distance from a reference plane to the polishing pad surface along a straight line or curved line that passes through the vicinity of the center of the polishing pad, wherein this method has a step in which, for respective data on both sides of the center of the polishing pad, using data that is located at a specified distance from either the maximum, minimum or mean value among the data, the two-dimensional center-of-gravity position of the data formed by this distance and the position of the polishing pad in the radial direction is first determined, and meanwhile, using the inclination of the line of regression determined using all of the measured data, or the inclination of a straight line indicating the surface of the polishing pad determined by the sixteenth invention, a straight line which has this inclination and which passes through the center-of-gravity position is determined, this is taken as the straight line of the groove bottom parts of the polishing pad, and the relative distance between this and the straight line indicating the surface of the polishing pad determined by the sixteenth invention is taken as the groove depth of the polishing pad.

The eighteenth invention that is used to achieve the object described above is a CMP polishing apparatus in which the polishing pad surface shape measuring device according to any of the first through twelfth inventions is built into the apparatus.

In this apparatus, the operations of polishing, dressing, pad replacement and pad measurement can be performed within the same apparatus; accordingly, the overall polishing process can be performed without wasting any time.

The nineteenth invention that is used to achieve the object described above is a semiconductor device manufacturing method, wherein this method has a step in which the surfaces of semiconductor wafers are flattened using the CMP polishing apparatus of the eighteenth invention.

The present invention makes it possible to manufacture semiconductor devices with a good throughput.

BEST MODE FOR CARRYING OUT THE INVENTION

Figure 1:
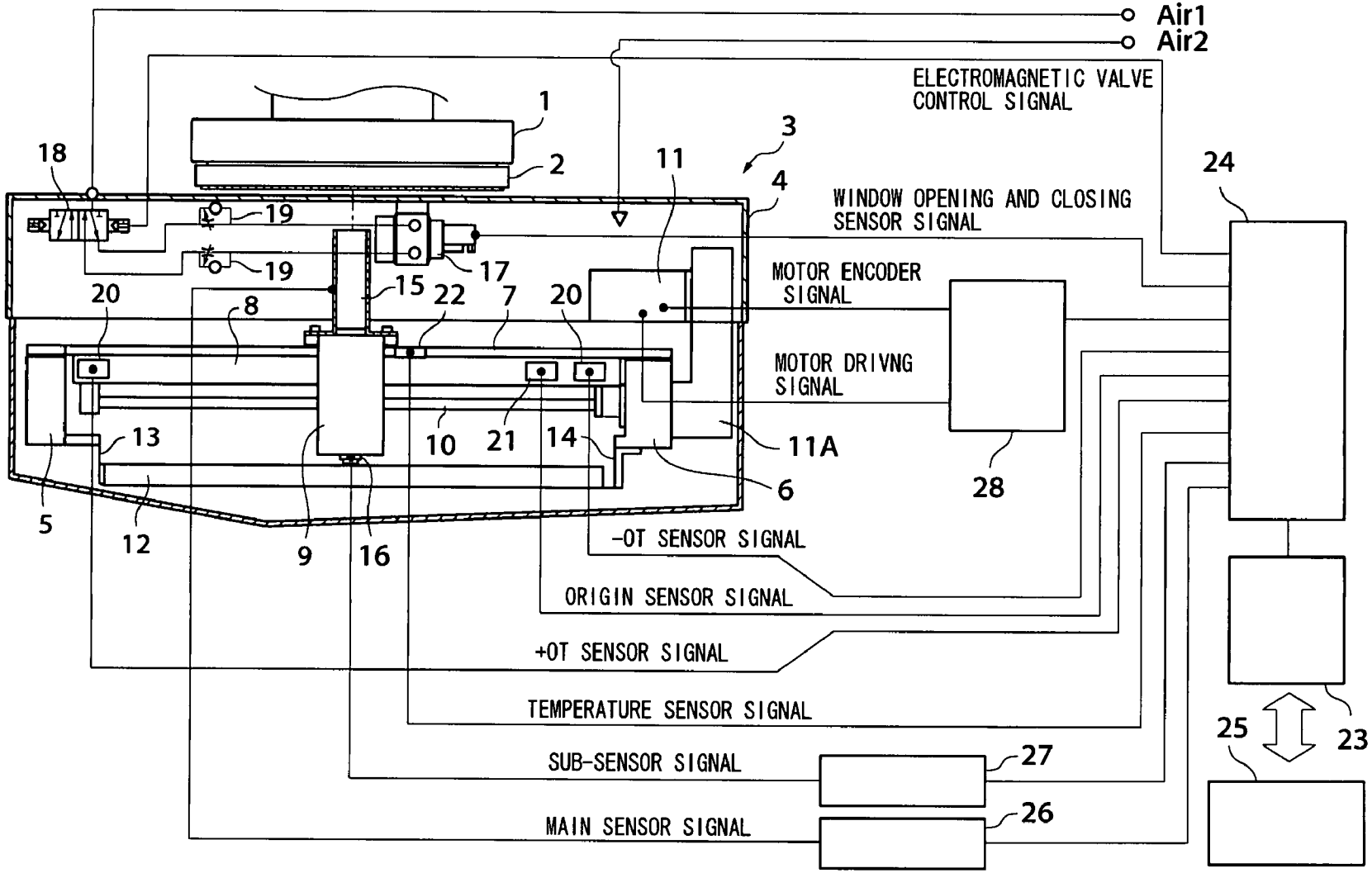
FIG. 1 is an overall schematic diagram showing the construction of a polishing pad surface shape measuring device constituting one example of a working configuration of the present invention.

Working configurations of the present invention will be described below with reference to the figures. FIG. 1 is an overall schematic diagram showing the construction of a polishing pad surface shape measuring device constituting a first example of a working configuration of the present invention. A polishing pad 2 is attached to the polishing head 1 by vacuum suction or the like. The polishing pad 2 is a part in which a polishing cloth called a pad such as a foam polyurethane is pasted to a metal pad plate. The polishing pad 2 is held on the tip end of a rotatable shaft by vacuum suction or the like. The mechanism that performs the rotational holding of this polishing pad is called the polishing head 1. The polishing cloth called a pad generally has lattice-form grooves, so that diffusion of the polishing liquid is promoted during polishing. The groove width is approximately 1 mm, and the depth is also approximately 1 mm.

The main body part 3 of the polishing pad surface shape measuring device which measures the surface shape of the polishing pad 2 is accommodated inside a housing 4 to which a waterproof cover is attached. A front block 5 and a rear block 6 are attached to the housing 4. A guiding and holding plate 7 made of austenitic stainless steel is attached between the front block 5 and rear block 6. A guide 8 constituting one slide block is attached to the guiding and holding plate 7. As will be described later, the movable element 9 is attached to a member which constitutes the other slide block; as a result, the movable element is made capable of sliding movement along the guide 8. Furthermore, a ball screw 10 is attached to the guiding and holding plate 7, and engages with a screw nut attached to the movable element 9 as will be described later, so that the movable element 9 is driven by the rotation of the ball screw 10.

A motor 11 is attached to the rear block 6 via a motor holding member 11A, and the ball screw 10 is caused to rotate by this motor. Furthermore, a reference block 12 is held on the front block 5 and rear block 6 via a first holding member 13 and a second holding member 14, respectively.

A main sensor 15 is disposed on the upper part of the movable element 9, and is devised so that this main sensor 15 measures the distance to the surface of the polishing pad 2. Furthermore, a sub-sensor 16 is disposed on the lower part of the movable element 9, and is devised so that this sub-sensor 16 measures the distance to the reference block 12. As will be described later, a window is installed in the side of the housing 4 that faces the polishing pad 2, and this window is opened only when the measurements are performed. An air cylinder 17 is provided in order to open and close this window, and an electromagnetic valve 18 and a speed controller 19 are provided in order to control this air cylinder. A window opening-and-closing sensor is disposed in the electromagnetic valve 18 or window in order to detect the opening and closing of the window. Besides an air cylinder, it would also be possible to use, for example, an electromagnetic actuator for the opening and closing of the window.

Furthermore, OT sensors 20 which are used to detect out-of-control operation of the movable element 9 and perform an emergency stop are installed on both sides of the guide 8, and an origin sensor 21 which is used to detect the origin position of the movable element 9 is disposed on the guide 8. Moreover, a temperature sensor 22 which is used to detect the temperature of the guide 8 is attached to the guiding and holding plate 7.

The polishing pad surface shape measuring device main body part 3 is controlled by a control device 23 via a control board 24. The control device 23 exchanges signals with a CMP apparatus control device 25. The exchange of signals such as that shown in the figure is performed between the control board 24 and various devices and members installed inside the polishing pad surface shape measuring device main body part 3. Among these signals, signals from the main sensor 15 are input into the control board 24 via a main sensor amplifier 26, and signals from the sub-sensor 16 are input into the control board 24 via a sub-sensor amplifier 27. Moreover, motor encoder signals (pulse signals) from the motor 11 are input into the control board 24 via a motor driver 28, and motor driving signals are output to the motor 11 from the control board 24 via the motor driver 28.

Furthermore, PVC is used as the material of the waterproof cover of the housing 4. It is sufficient if the material of the waterproof cover is resistant to the moist atmosphere inside the polishing chamber and the atmosphere of the slurry. Moreover, the system is devised so that there is a drain structure that can drain water from the bottom even if water should invade. The waterproof cover is split into a bottom part cover and a lid part cover so that the overall mechanism part of the polishing pad surface observing device is covered. A window is formed in the lid part cover as described above.

Figure 2:
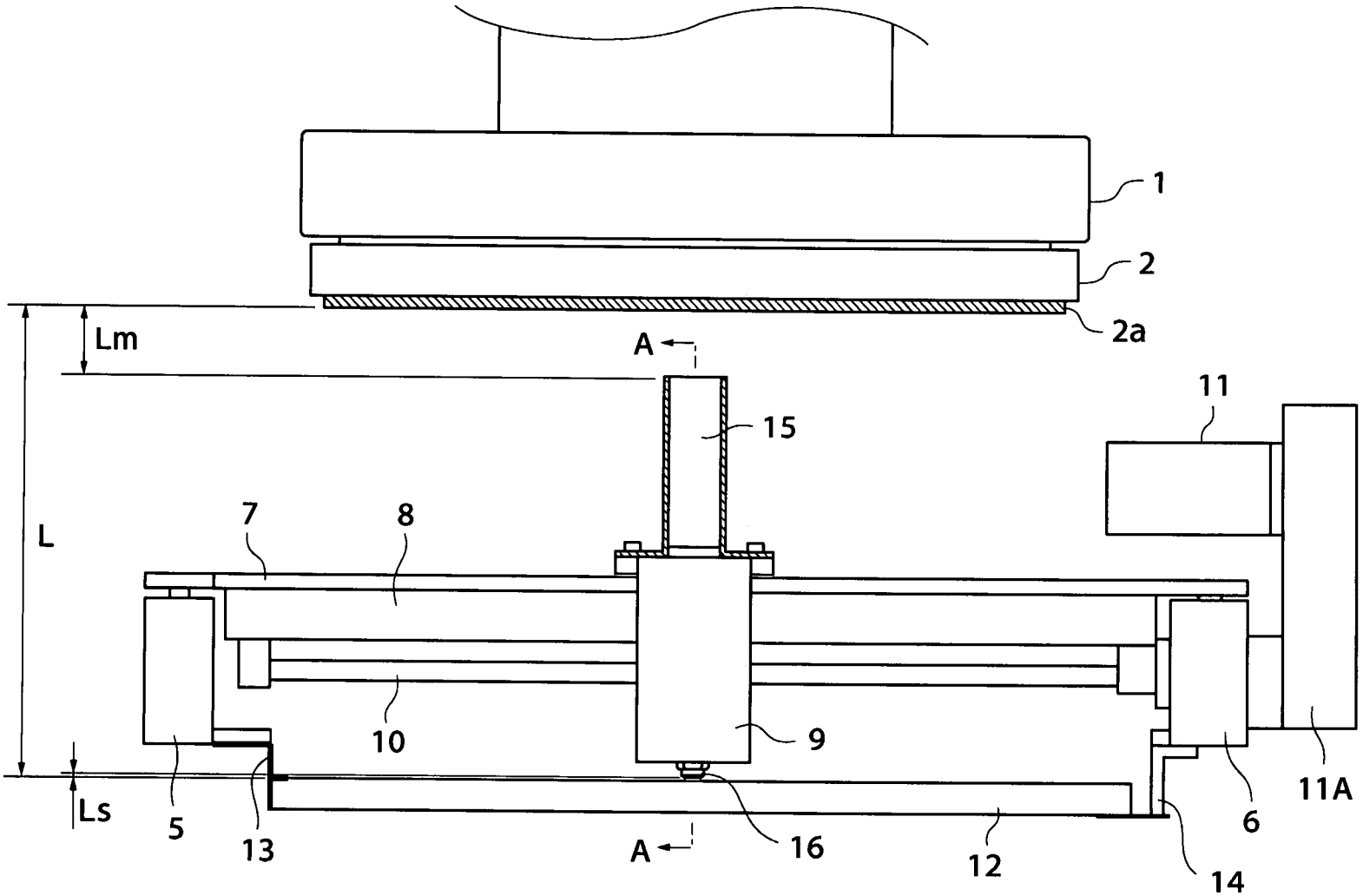
FIG. 2 is a detailed diagram of the essential parts of the main body part of the polishing pad surface shape measuring device.

FIG. 2 shows a detailed diagram of the essential parts of the polishing pad surface shape measuring device main body part 3. Furthermore, in the following figures, there may be instances in which constituent elements that are the same as constituent elements shown in preceding diagrams in this section are labeled with the same symbols, and a description of these constituent elements is omitted. A pad 2*a* is attached to the surface of the polishing pad 2, and what is actually measured is the shape, groove depth, thickness, and the like of this pad 2*a*. The main sensor 15 measures the distance Lm to the surface of the pad 2*a*, and the sub-sensor 16 measures the distance Ls to the surface of the reference block 12. What is actually taken as the measured value is the value of (Lm+Ls) in a polarity which is such that Lm decreases and Ls increases as the movable element 9 approaches the pad. Meanwhile, the reference block 12 is specifically used in order to give a reference position for measuring the surface position of the pad 2*a*; accordingly, for example, correct measurements can be made even if the position of the movable element 9 should fluctuate as a result of deformation of the guiding and holding plate 7 or guide 8. Furthermore, as will be described later, a special device is constructed in the first holding member 13 and second holding member 14 that hold the reference block 12 so that this reference block 12 will not be deformed by stress.

The system is devised so that in the measurement position, the vicinity of the center of the pad 2*a* passes through the measurement line of the main sensor 15. As a result of the movable element 9 moving in the left-right direction of the figure due to the rotation of the ball screw 10, the distance to the surface of the pad 2*a* along a line passing through the vicinity of the center of the pad 2*a* can be measured. Consequently, the surface shape of the pad 2*a* along a line passing through the vicinity of the center of the pad 2*a* can be measured. Furthermore, by rotating the polishing head 1, it is possible to measure the surface shape of the pad 2*a* along a plurality of lines passing through the vicinity of the center of the pad 2*a*. Furthermore, the measurement position is not limited to the center of the pad 2*a*; it is sufficient if this measurement position is in the vicinity of the center of the pad 2*a*. The distance measurement device shown in the respective figures for the present working configuration is a device that performs a rectilinear movement. However, it would also be possible to use a device in which an arm that supports a sensor part rotates about a certain axis of rotation as the distance measurement device. In this case, the measurement position is a circular-arc-form position that passes through the center or vicinity of the center of the pad 2*a*.

An optical type displacement sensor is used as the main sensor 15 in the present working configuration. Since the measurement object surface is the pad 2*a* described above, this surface is a foam resin. Since the pore diameter of the foam body is 20 to 30 μm, it is desirable that the optical type sensor spot be larger than this pore area. Since the groove width is approximately 1000 μm, it is desirable that the spot diameter be smaller than the groove width. In the case of a contact type pick sensor, the depth of the groove parts cannot be detected since the tip end of the probe has a diameter of 1 mm or greater. In the case of eddy current type sensors and ultrasonic type sensors as well, the measurement range is a diameter of approximately 5 mm; accordingly, the groove parts similarly cannot be detected.

In the present working configuration, an eddy current type displacement sensor is used as the sub-sensor 16. In order to increase the measurement sensitivity and reduce the effects of noise, a ferric material or martensite type stainless steel is used as the reference block 12. In cases where there is no particular need for precision, various types of metals such as aluminum and copper type metals may also be used. Although the surface of 12 is precision-worked to a flat surface, it is desirable to use an eddy current type displacement sensor in which the mean distance in a diameter range of around several millimeters can be calculated.

The measurement points of the main sensor 15 and the measurement points of the sub-sensor 16 are disposed on the same axis as the driving points of the movable element 9, and the axes connecting three points are perpendicular to the driving direction of the movable element 9. If this disposition is used, fluctuation of the measurement point in the measurement direction due to pitching and rolling of the movable element 9 can be ignored as a secondary negligible term.

The motor 11 may be an AC motor, a DC motor or a stepping motor. A rotary encoder is built in, so that the position of the movable element is detected. With regard to the position of the origin, an origin sensor 21 is attached to the guide 8, and the system is devised so that an origin reset operation is performed when the movable element 9 passes through this position. In cases where the rotary encoder is an absolute value type encoder, and the mechanical system including the ball screw has sufficient precision, the origin sensor 21 is unnecessary. Furthermore, a combination of a linear motor and a linear encoder may also be used. A mechanism is used in which torque is transmitted to the ball screw 10 from the motor shaft via a gear mechanism, a belt, and the like.

Figure 3:
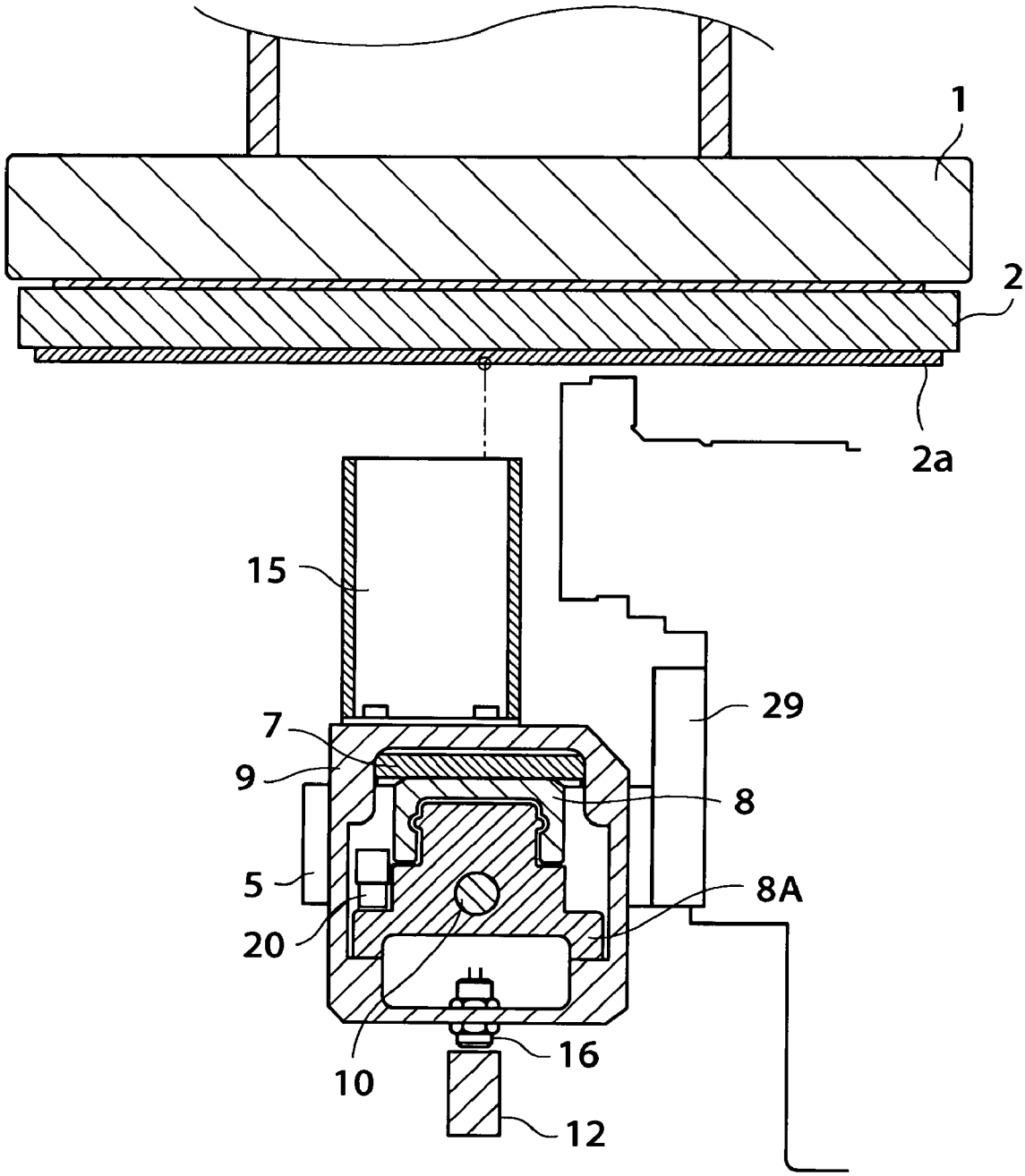
FIG. 3 is a sectional view along line A-A in FIG. 2.

FIG. 3 is a sectional view along line A-A in FIG. 2. The front block 5 is attached to an attachment stand 29 which is attached to the housing 4, and the guiding and holding plate 7 is attached to and held by the front block 5. Furthermore, the guide 8 is fastened to the guiding and holding plate 7. A slide table 8A is engaged with the guide 8 so that this slide table 8A can slide, and the guide 8 and slide table 8A form a slide block. A screw nut is inserted into the slide table 8A, and the ball screw 10 is screwed into this screw nut. The movable element 9 is fastened to the slide table 8A, and is caused to slide along the guide 8 together with the slide table 8A by the rotation of the ball screw 10. As is shown in the figures, the main sensor 15 and sub-sensor 16 are fastened to the movable element 9.

Figure 4:
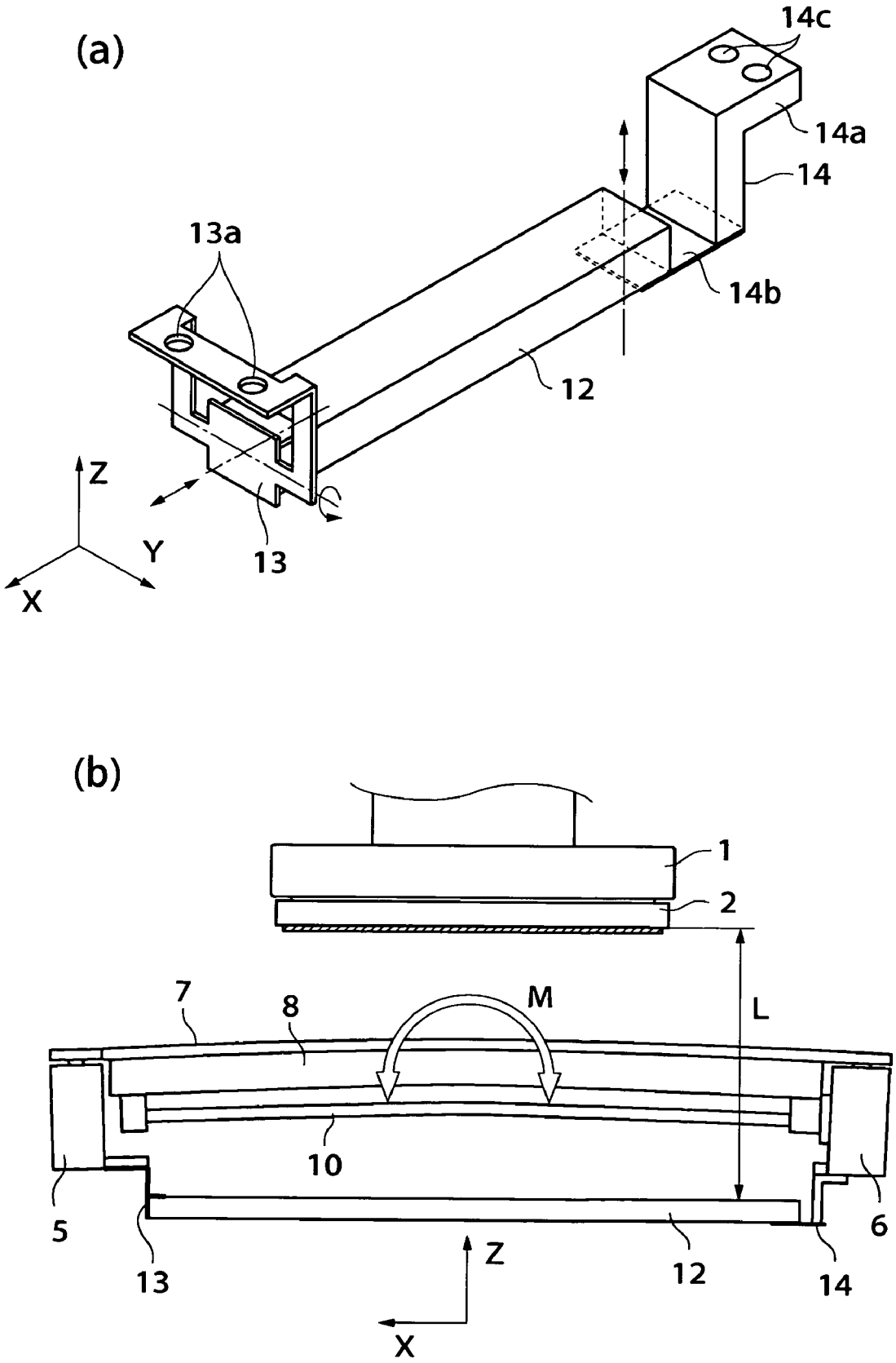
FIG. 4 is a diagram used to illustrate the roles of the first retaining member and second retaining member.

FIG. 4 is a diagram which is used to illustrate the roles of the first holding member 13 and second holding member 14. As is shown in FIG. 4(*a*), the first holding member 13 and second holding member 14 are members that hold the reference block 12. The first holding member 13 is constructed from a plate spring. Furthermore, in the x-y-z orthogonal coordinate system shown in the figure, the reference block 12 is held so that this block has degrees of freedom with respect to displacement in the x direction and torsion about the y axis in the figure. In other words, the first holding member 13 is a holding member which has degrees of freedom in two dimensions.

The second holding member 14 is constructed from a rigid body part 14*a* and a plate spring part 14*b*; through the action of the plate spring part 14*b*, this second holding member 14 holds the reference block 12 so that the reference block 12 has a degree of freedom with respect to displacement in the z direction. In other words, the second holding member 14 is a holding member which has a degree of freedom in one dimension.

Both ends of the reference block 12 are held by the first holding member 13 and second holding member 14, so that (for example) a moment M is applied to the guide part as shown in FIG. 4(*b*). Even if the guide 8 is deformed as shown in the figure, the first holding member 13 and second holding member 14 receive the deformation caused by the moment, so that no bending occurs in the reference block 12. Accordingly, the rectilinear characteristics of the reference block 12 are ensured, so that the circular-conical vertical angle of the polishing pad can be correctly measured.

Furthermore, it would also be possible to replace the second holding member 14 with another first holding member 13, and to hold the reference block 12 from both sides via these first holding members 13.

Figure 5:
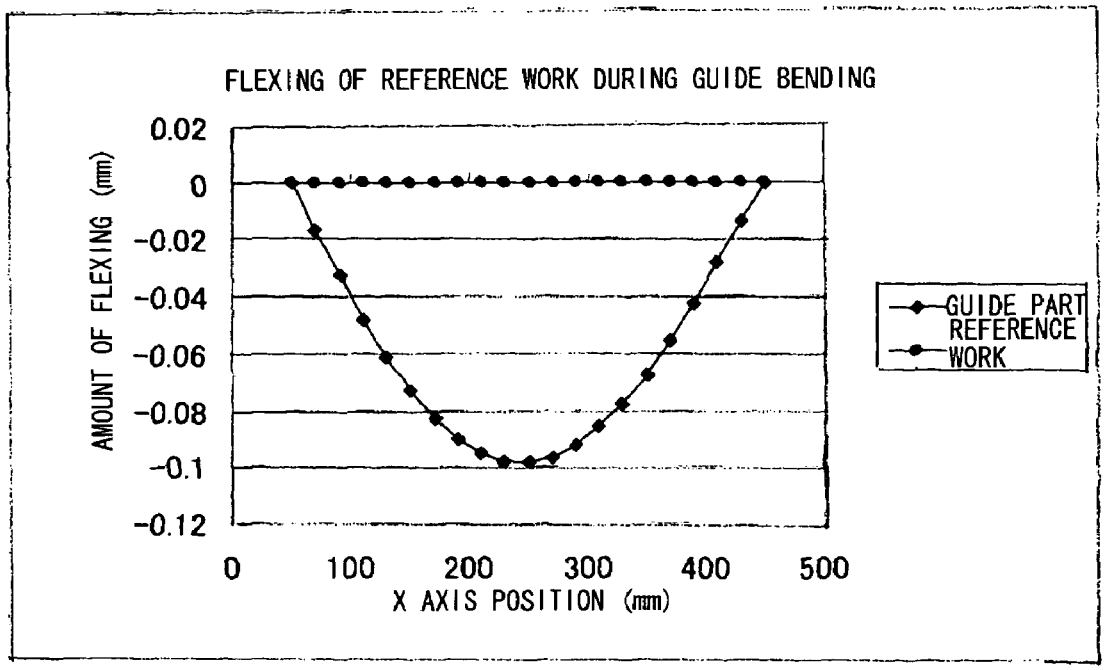
FIG. 5 is a diagram showing the results obtained by calculating the effect of the retaining structure.

FIG. 5 shows the results of a calculation of the holding effect of the present holding structure. In FIG. 5, the horizontal axis shows the position of the guide 8, and the vertical axis shows the amount of bending. As is shown in this figure, bending is generated in the guide 8 by the bending moment; however, no bending is generated in the reference block 12.

Figure 6:
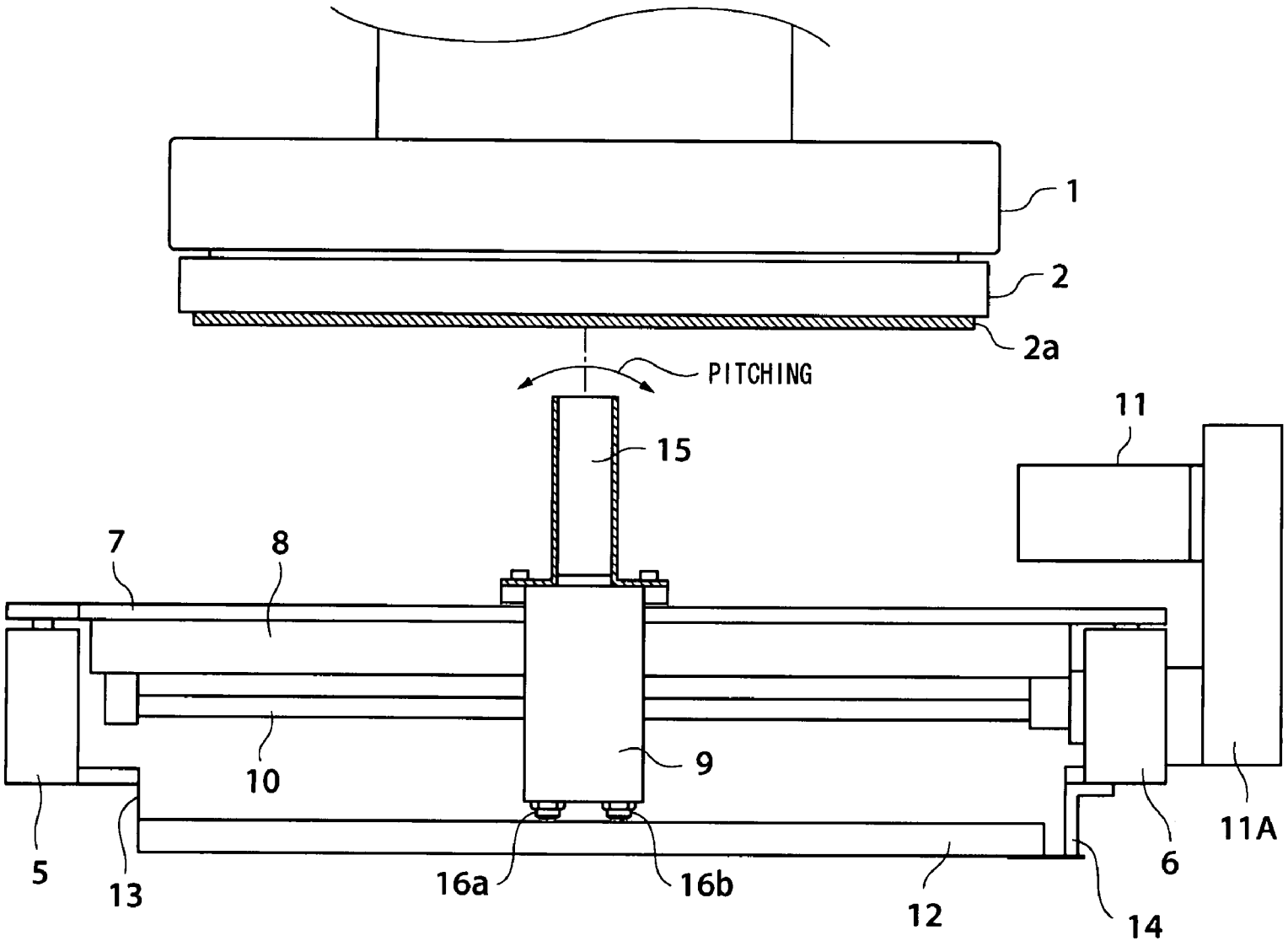
FIG. 6 is a diagram showing the construction of the essential parts of a polishing pad surface shape measuring device constituting a second example of a working configuration of the present invention.

FIG. 6 is a diagram showing the construction of the essential parts of a polishing pad surface shape measuring device constituting a second example of a working configuration of the present invention. As is seen from a comparison of FIGS. 2 and 6, this working configuration differs from the first working configuration only in that this working configuration has two sub-sensors as indicated by 16*a* and 16*b* in the direction of length of the reference block 12. Therefore, a description of parts that are the same as in FIG. 2 will be omitted, and only parts that are different will be described.

A comparison of the outputs of the sub-sensor 16*a* and sub-sensor 16*b* shows the extent to which the movable element 9 is inclined in the direction of length of the reference block 12, i.e., the amount of pitching of the movable element 9. If this pitching amount is designated as v, then a distance obtained by multiplying the actually measured distance by cos v is the true distance. Consequently, for example, pitching error accompanying bending of the guide 8 can be corrected.

Figure 7:
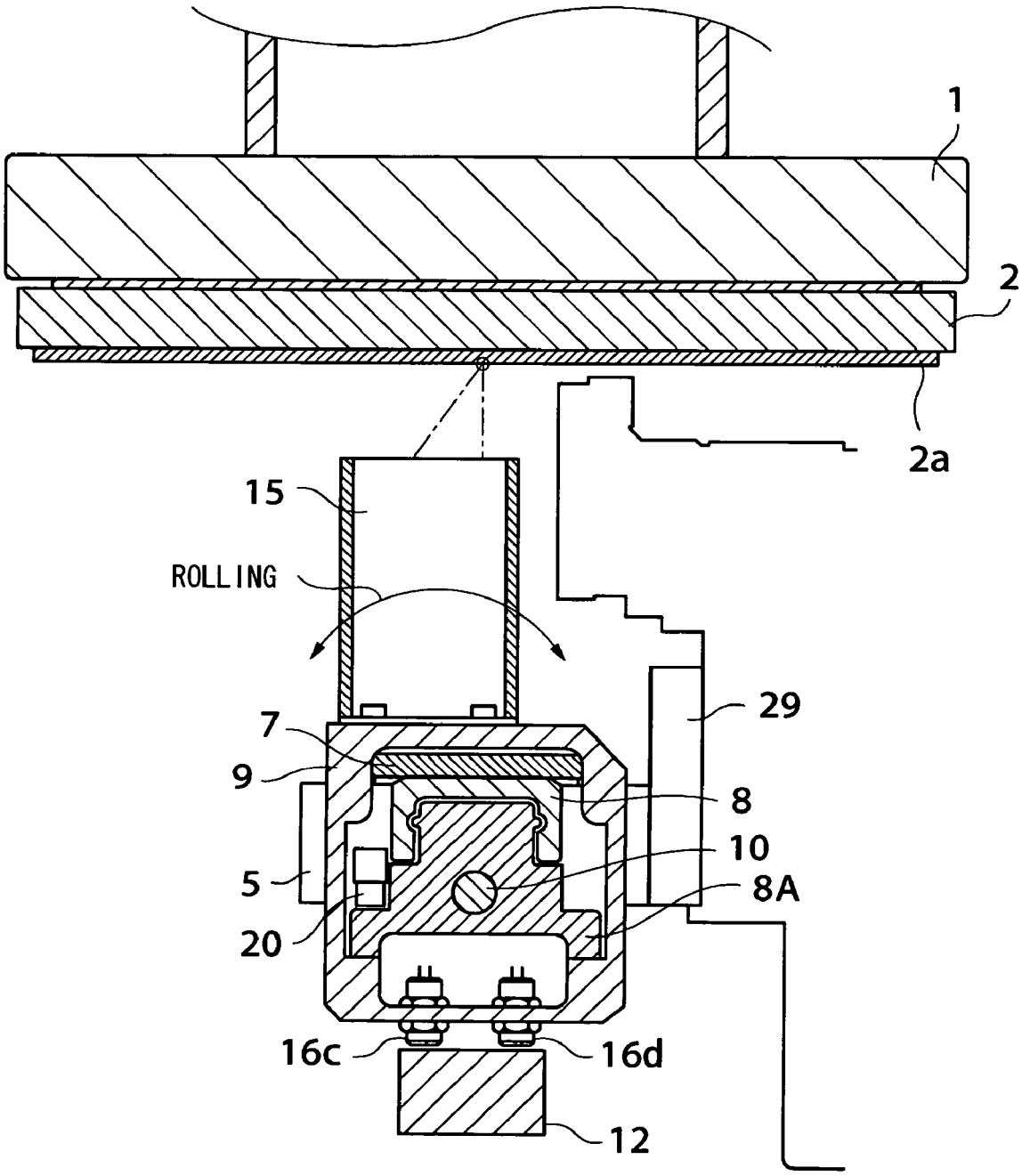
FIG. 7 is a diagram showing the construction of the essential parts of a polishing pad surface shape measuring device constituting a third example of a working configuration of the present invention.

FIG. 7 is a diagram showing the construction of the essential parts of a polishing pad surface shape measuring device constituting a third example of a working configuration of the present invention. As is seen from a comparison of FIGS. 3 and 7, this working configuration differs from the first working configuration only in that this working configuration has two sub-sensors as indicated by 16*c* and 16*d* in the direction of width of the reference block 12. Accordingly, a description of parts that are the same as in FIG. 3 is omitted, and only parts that are different are described.

A comparison of the outputs of the sub-sensor 16*c* and sub-sensor 16*d* shows the extent to which the movable element 9 is inclined in the direction of width of the reference block 12, i.e., the amount of rolling of the movable element 9. If this rolling amount is designated as ω, then a distance obtained by multiplying the actually measured distance by cos ω is the true distance. Consequently, for example, rolling error accompanying bending of the guide 8 can be corrected.

Figure 8:
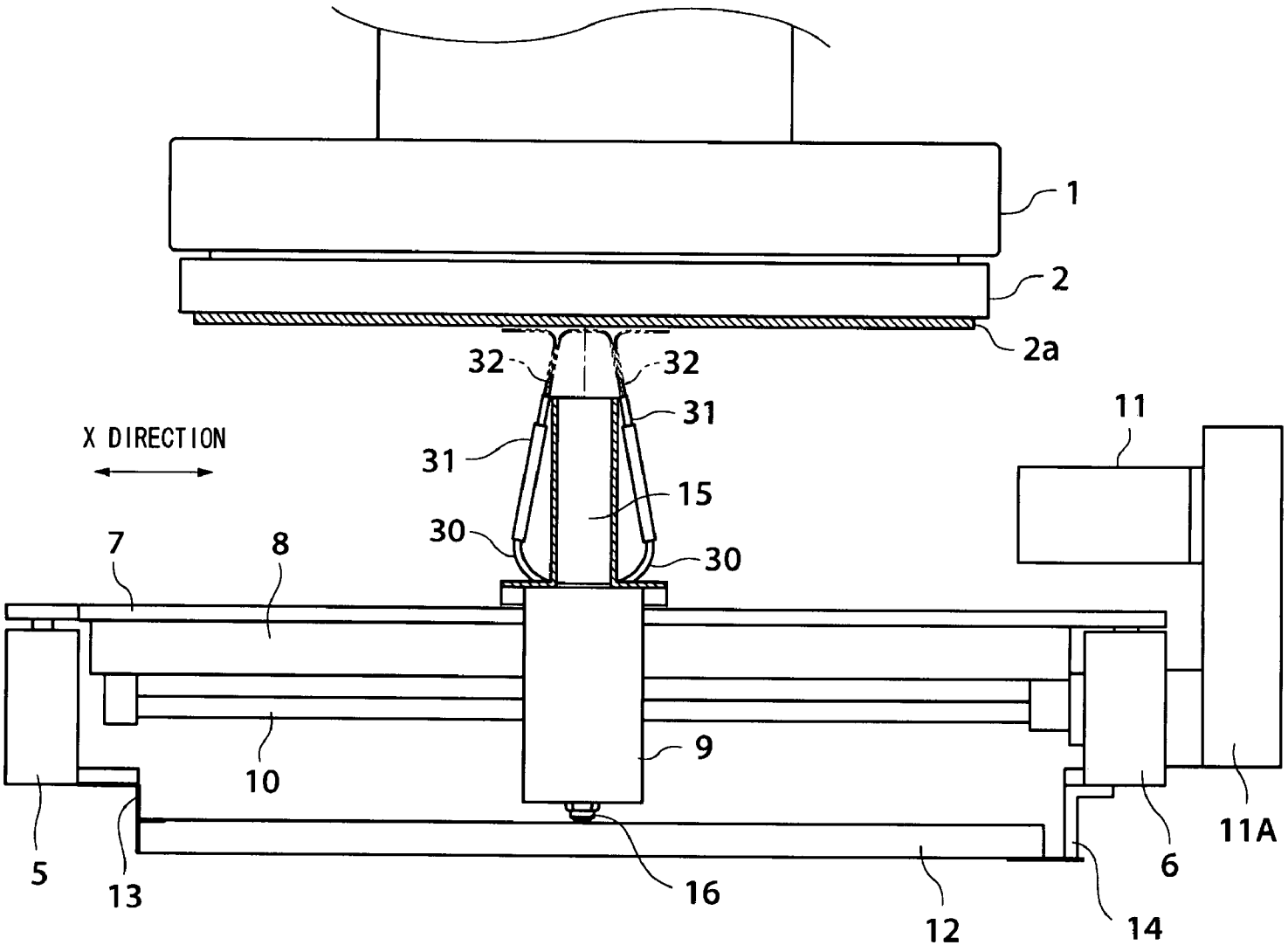
FIG. 8 is a diagram showing the construction of the essential parts of a polishing pad surface shape measuring device constituting a fourth example of a working configuration of the present invention.

FIG. 8 is a diagram showing the construction of the essential parts of a polishing pad surface shape measuring device constituting a fourth example of a working configuration of the present invention. As is seen from a comparison of FIGS. 2 and 8, this working configuration differs from the first working configuration only in that an air blowing mechanism for the measurement surface is provided. Therefore, a description of parts that are the same as in FIG. 2 is omitted, and only parts that are different will be described.

In this working configuration, air piping 30 is attached to the movable element 9, air nozzles 31 are disposed on the tip ends of the air piping 30, and air 32 is blown onto the measurement surface of the pad 2*a* from the air nozzles 31. As a result, liquids such as moisture remaining on the surface of the pad 2*a* are purged, so that accurate measurements can be performed. It would also be possible to use a dry gas such as nitrogen instead of air. A blowing flow rate that is sufficient to cause the scattering of water droplets is desirable. Furthermore, in the figure, the air nozzles 31 are in front and back in the direction of movement of the movable element 9. The reason for this is as follows: namely, since there may be cases in which the movable element 9 performs a reciprocating motion, this is done in order to allow the blowing of air beforehand onto locations corresponding to the measurement points regardless of the direction in which the movable element 9 is moving.

Figure 9:
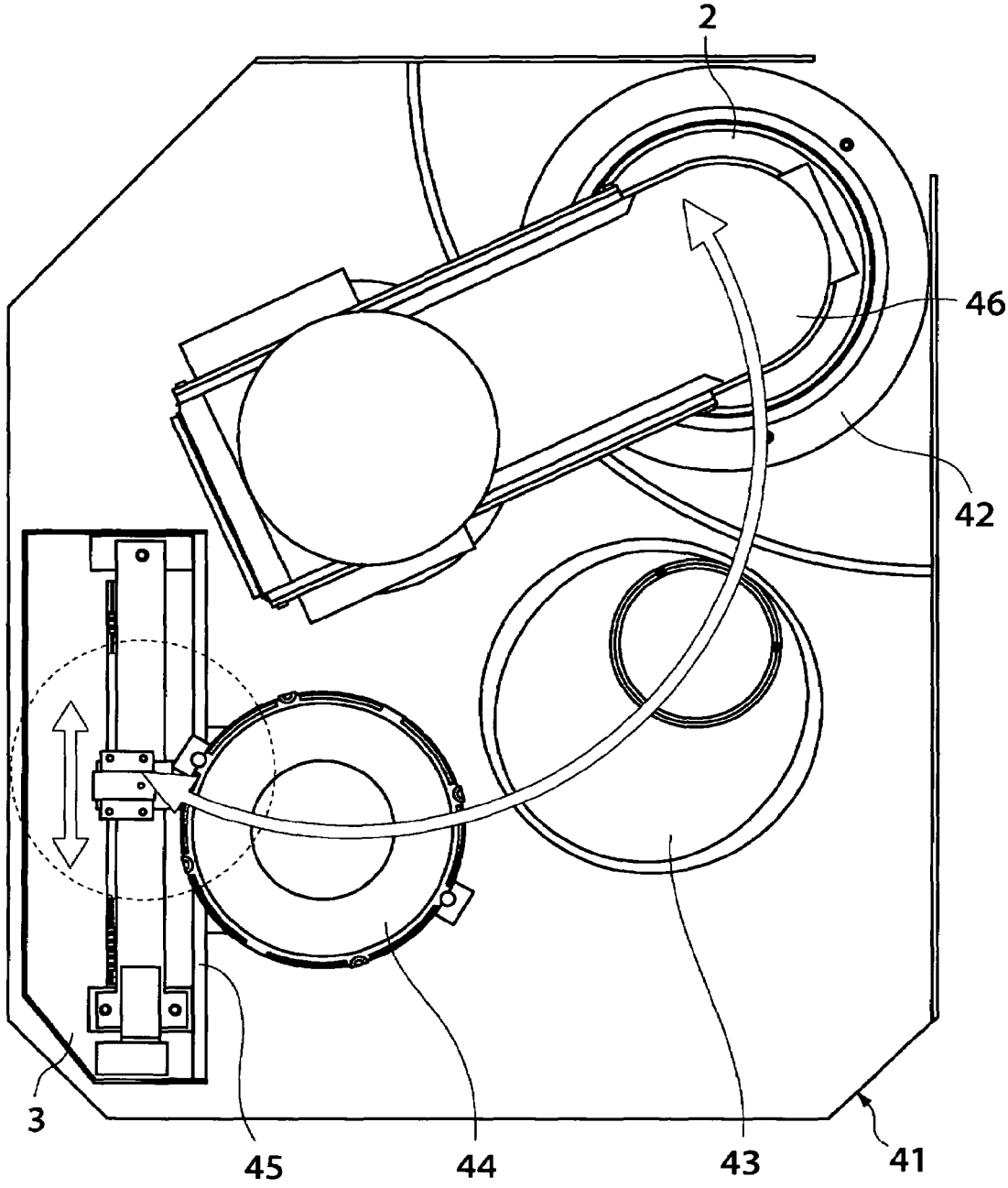
FIG. 9 is a diagram showing an outline of a polishing chamber in which a polishing pad surface shape measuring device constituting a working configuration of the present invention is installed.

FIG. 9 is a diagram showing an outline of the polishing chamber in which the polishing pad surface shape measuring device constituting a working configuration of the present invention is disposed. As in a conventional system, a polishing station 42, a dressing station 43 and a pad replacement station 44 are disposed in this polishing chamber 41; in addition, however, a polishing pad surface shape measuring device main body part 3 is disposed on top of an attachment stand 45.

The polishing pad 2 held on the rotating type swinging arm 46 is arranged so that this polishing pad 2 can also be positioned on top of the polishing pad surface shape measuring device main body part 3 in addition to the polishing station 42, dressing station 43 and pad replacement station 44 by the rotation of 46.

When a specified number of polishing passes of the wafer has been completed, the rotating type swinging arm 46 causes the polishing pad 2 to move from the polishing station 42 to the dressing station 43, and performs dressing of the polishing pad 2. After dressing is completed, the rotating type swinging arm 46 causes the polishing pad 2 to move from the dressing station 43 to the position of the polishing pad surface shape measuring device main body part 3, and measures the surface shape (circular-conical vertical angle, groove depth) and pad thickness of the polishing pad 2. In cases where the pad thickness and groove depth are equal to or below specified values, the polishing pad 2 is caused to move to the pad replacement station 44, and the polishing pad 2 is replaced; furthermore, the polishing pad 2 is then caused to move to the polishing station 42, and the polishing of a new wafer is performed.

If the pad thickness and groove depth are equal to or greater than the specified values, but the circular-conical vertical angle of the pad does not enter the specified range of values, the polishing pad 2 is returned to the dressing station 43, and dressing is reperformed with the dressing conditions being altered; subsequently, an operation in which the measurement of the surface shape of the polishing pad 2 is again performed is repeated.

In cases where the pad thickness and groove depth are equal to or greater than the specified values, and the circular-conical vertical angle is within the specified range of values, the polishing pad 2 is returned to the polishing station 42, and the polishing of a new wafer is initiated.

Below, the sequence of the measurement operation, the calculation of the circular-conical vertical angle, the calculation of the groove depth, and the calculation of the pad thickness performed by the polishing pad surface shape measuring device constituting the working configuration of the present invention described above will be described.

(Step 1) At the same time that the initializing power supply of the polishing pad surface shape measuring device is switched on, the initialization of the CPU and the initialization of the motor 11 are performed. In the motor initialization, the motor is driven at a constant rpm (constant speed in the case of the movable element) in a constant rotational direction (single direction on the X axis in terms of the driving coordinates of the movable element 9). During this movement, the movable element 9 passes through the origin sensor 21 disposed in the vicinity of the guide 8. At the timing of this passage, the counter of the motor encoder is reset to 0, so that the X coordinate from the origin can be confirmed, and the position of the movable element 9 in the X direction can be detected. The term "CPU" refers to a control CPU mounted on the control board 24, a control CPU located in the control device 23, and the like. Generally, the initialization of the polishing pad surface observing device is performed in accordance with the switching-on of the power supply of the CMP apparatus.

(Step 2) At a timing following the completion of the polishing of n wafers, the CMP apparatus initiates the dressing of the polishing pad for the purpose of measuring the pad surface. With regard to these dressing conditions, the dressing time is set mainly for the purpose of removing the polishing residue and slurry components in the same dressing position as that used during the polishing of wafers.

(Step 3) In an optical type sensor, water droplets may constitute a factor in the measurement error. Accordingly, the scattering of water droplets in the vicinity of the maximum rpm of the head is performed in order to remove adhering droplets of polishing water used in dressing. As a result, a uniform water retention layer is obtained on the pad surface following the cleaning of the cells of the pad. The water scattering position may be located in the vicinity of the dressing station.

(Step 4) At the point in time at which the scattering of water droplets on the pad surface is completed, the CMP apparatus control device 25 transmits a window opening command that is used to open the observation window to the control device 23. The control device 23 receiving this command sends an electromagnetic valve control signal that is used to open the window to the electromagnetic valve 18 via the control board 24. As a result, the valve is switched so that the air cylinder 17 is actuated. The air cylinder 17 drives a member connected to the window to a specified position, and thus opens the window. The opening end point is detected by a sensor installed in the air cylinder 17, and the window opening operation is completed. The control device 23 notifies the CMP apparatus control device 25 of the completion of the execution of the window opening command.

(Step 5) Simultaneously with the transmission of the window opening command in step 4, the CMP apparatus control device 25 moves to the observation point of the polishing head 1. Simultaneously with this movement or following the completion of this movement, the rotational position of the polishing head 1 is aligned with the initial position (i.e., the rotation initialization position of the polishing head). With the completion of the later of these two steps (i.e., step 4 and this step), the observation positioning of the pad is completed.

(Step 6) The CMP apparatus control device 25 transmits a measurement command to the control device 23. The control device 23 sends a measurement command to the control board 24, and the control board 24 sends a driving command to the motor driver 28, thus causing the movable element 9 to move. The Z-axis direction distance measurement values of the main sensor 15 and sub-sensor 16 are taken in at a specified sample pitch from the X-axis position information obtained from the encoder. In this case, the measurement initiation point and end point in the direction of the X axis are set in advance as parameters. In order to use the reference work surface as a reference surface, assuming a construction in which Lm is the main sensor output, Ls is the sub-sensor output, and a smaller Lm output and a larger Ls output are obtained as the movable element 9 approaches the polishing pad 2, the relative distance L from the reference surface to the pad surface is obtained as L=(Lm+Ls).

The measurement method used for the circular-conical vertical angle, groove depth and polishing pad thickness will be described in detail later. When these values have been determined, the control device 23 sends a measurement command completion signal to the CMP apparatus control device 25.

(Step 7) The CMP apparatus control device 25 receiving the measurement command completion signal causes the polishing head 1 to rotate by a specified angle. After pivoting by this rotational angle, the CMP apparatus control device 25 again transmits a measurement command to the control device 23. Then, the rotation and measurement of the polishing head are repeated until the entire surface of the polishing pad 2 is scanned. For example, if the increment is 10 degrees, the entire surface can be measured by a reciprocating scanning operation of 18 passes.

(Step 8) A prerequisite condition for data processing is that the CMP apparatus control device 25 must have discriminating information for the polishing pad 2 and pad conditioner (dresser) 47 used in measurement. This is done in a form in which a discrimination No. is input into the CMP apparatus control device 25 at the time of initial attachment or at the time of replacement. As is shown in the example given in step 7, it is assumed that 18 measurement passes are performed.

For example, the discriminator of the polishing pad 2 is designated as pad001, and the discriminator of the pad conditioner 47 is designated as pcn001. With regard to the circular-conical vertical angle supplementary angle θ, among 18 sets of data, the average of 16 sets of data excluding the maximum and minimum values is calculated, and is left in memory as the mean value θm of the circular-conical vertical angle supplementary angle. Similarly, in the case of the groove depth dfe as well, a mean value is taken, and is left in memory as the mean value dfem of the groove depth of pad001. In the case of the pad thickness pad_t(n), the dressing rate Rpcn=(pad_t(n)−pad_t(n−1))/tdsum of pcn001 is calculated using pad_t(n−1) of the previous measurement and the cumulative dressing time tdsum during measurement, and this is left in memory.

The CMP apparatus control device 25 has a reference value that serves as an indicator for alteration of the dressing position, replacement of the polishing pad 2 or replacement of the pad conditioner 47. By comparing this reference value and the measurement results, this control device 25 creates and reports warning information and the like used to alter the dressing position, to replace the polishing pad 2, or to replace the pad conditioner 47. Following this report, the CMP apparatus control device 25 may automatically perform a position altering operation, pad replacement or pad conditioner replacement. Furthermore, even in cases where the polishing pad 2 or pad conditioner 47 is replaced prior to warning during the polishing operation, and is again mounted, the history for each discriminator is held in memory; accordingly, continuous management is possible.

Details of the above-mentioned reference value serving as an indicator for alteration of the dressing position, replacement of the polishing pad 2 or replacement of the pad conditioner 47 will be described below using the dressing position shown in FIG. 10.

With regard to the alteration of the dressing position, the reference value is held as the circular-conical vertical angle α, the supplementary angle θ or the concavo-convex displacement δ. For example, in cases where the supplementary angle θm measured at the current dressing position pos1 is located on the plus side from the target value, the dressing position is altered to a dressing position pos3 in which the supplementary angle θ is negative. Incidentally, the dressing position refers to the distance between the center of rotation of the pad conditioner and the center of rotation of the pad. The dressing time is set at a value that is determined by the relationship between the dressing position pos3 and the difference between θm and the target value θt, and correction dressing is performed at this dressing position and dressing time. Following correction dressing, the sequence from step 3 to step 7 described above is performed again, and this is continued until the reference value is reached or until the sequence has been repeated a specified number of times.

The reference value means that a lower limit θ Llim and an upper limit θ Hlim are held, and that θ Llim≦θm−θt≦θ Hlim is within the reference value range. With regard to the dressing position at which polishing is performed after entering the reference value range, this position may be returned to the initial POS1, or may be altered slightly from POS1 toward POS3 from the results obtained under the correction dressing conditions.

With regard to the replacement of the pad 2, the reference value is held by the pad groove depth dfem. A lower limit dfelim is held by the reference value, and a pad replacement warning is issued in cases where dfem<dfelim.

With regard to the replacement of the pad conditioner 47, the reference value is held by the dressing rate Rpcn. The reference value holds the lower limit Rpcnlim, and issues a pad conditioner replacement warning in cases where Rpcm<Ppcnlim.

Below, the method used to measure the circular-conical vertical angle of the pad 2*a* will be described. Prior to this, however, the method used to determine the circular-conical vertical angle will be described with reference to FIG. 10. FIG. 10 shows the conditions of dressing. This figure shows a state in which dressing is performed by polishing the pad 2*a* of the polishing pad 2 using the pad conditioner 47.

Dressing is accomplished by polishing the pad 2*a* by means of the pad conditioner 47 while causing rotation of the polishing pad 2 and pad conditioner 47. In this case, if the center of rotation of the pad conditioner 47 is in a position that is distant from the center of rotation of the polishing pad 2, then the pad 2*a* is polished in a state which is such that the center of the pad 2*a* becomes thick, and the peripheral parts become thin as shown in FIG. 10(*a*). Conversely, if the center of rotation of the pad conditioner 47 is in a position that is close to the center of rotation of the polishing pad 2, then the pad 2*a* is polished in a state which is such that the center of the pad 2*a* becomes thin, and the peripheral parts become thick as shown in FIG. 10(*c*). If the center of the pad conditioner 47 is in a position that is intermediate between the state shown in FIG. 10(*a*) and the state shown in FIG. 10(*c*), then polishing is performed so that the surface of the pad 2*a* becomes flat as shown in FIG. 10(*b*).

Figure 10:
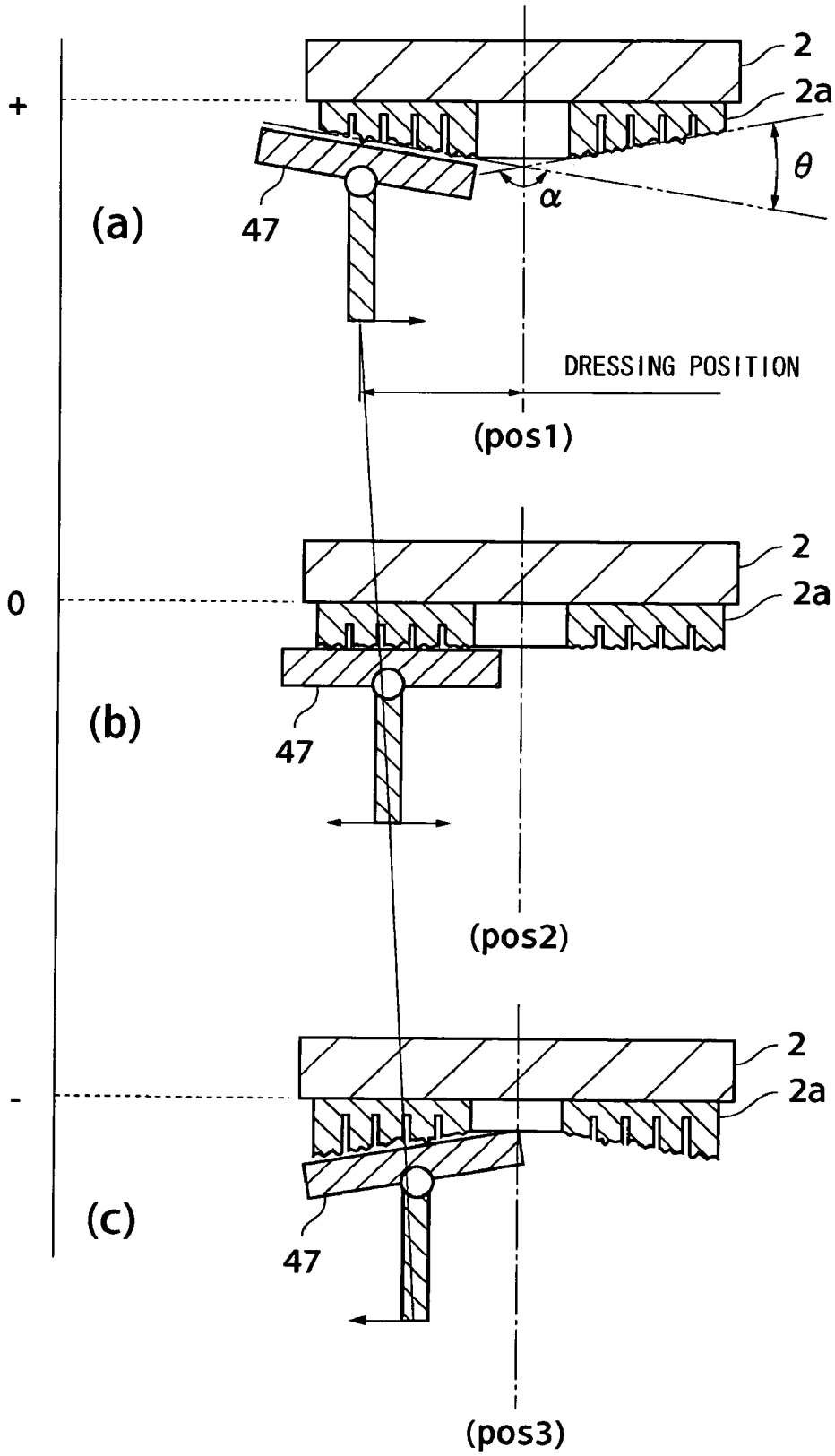
FIG. 10 is a diagram showing the conditions of dressing.

Cases in which the circular-conical vertical angle a is such that α<π as shown in FIG. 10(*a*) are defined as a convex pad, cases in which α>π as shown in FIG. 10(*c*) are defined as a concave pad, and cases in which α=π as shown in FIG. 10(*b*) are defined as a flat pad. Since the supplementary angle θ of the circular-conical vertical angle α shown in the figures is expressed as (π−α), then, focusing on the supplementary angle θ, a case where α=0 is a flat pad, a case where θ>0 is a convex pad, and a case where α<0 is a concave pad. From such a relationship, it is sufficient if either α or θ is determined in order to determine the circular-conical vertical angle.

Figure 11:
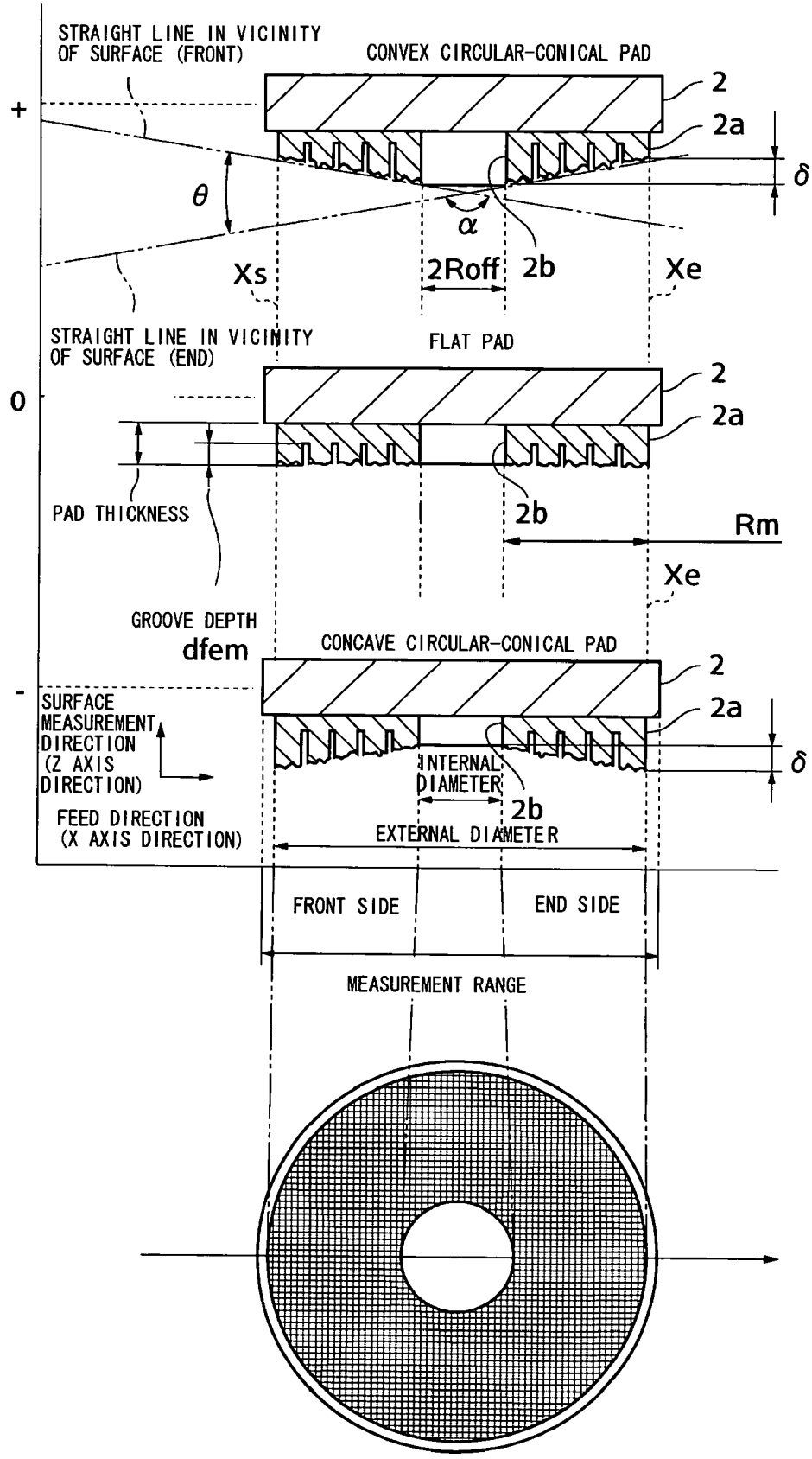
FIG. 11 is a diagram showing parameters that indicate the shape of the pad.

FIG. 11 shows parameters that indicate the shape of the pad 2*a*. As is shown in FIG. 11, the difference in height between the outer circumferential part and inner circumferential part of the pad 2*a* is defined as the concavo-convex displacement δ. In a case where Rm=(external diameter of pad−internal diameter of pad)/2, the supplementary angle θ that is the object of measurement is extremely small, so that δ=Rm*θ/2 always holds true. Applying this to the definition of the polarity described above, the polarity of δ is + in the case of a convex pad, and the polarity of δ is − in the case of a concave pad.

In FIG. 11, measurement of the distance to the pad 2*a* by the distance measuring device is taken as being performed from the left side to the right side; with the center of the pad 2*a* as a boundary, the left side of the figure will be called the front side, and the right side of the figure will be called the end side. Furthermore, an x-z orthogonal coordinate system is considered in which the x coordinate is taken in the left-right direction in the figure, and the z coordinate is taken in the vertical direction.

The x coordinate of the measurement initiation point is designated as Xs, and the measurement end point is designated as Xe. Ordinarily, Xs and Xe are in symmetrical positions with respect to the center of the pad 2*a*. A hole 2*b* is formed in the central portion of the pad 2*a*, and the pad 2*a* is not disposed in this portion. This diameter (internal diameter of the pad 2*a*) is designated as $2R_{off}$. Then, the effective measurement region on the front side is the region of Xs ~$\{(Xs+Xe)/2-R_{off}\}$, and the effective measurement region on the end side is the region of $\{(Xs+Xe)/2+R_{off}\}$~Xe.

In such a state, the surface on the front side of the pad 2*a* in FIG. 11 is approximated by a straight line; the method used to determine this straight line will be described below. The method used to determine the straight line on the end side is also similar; accordingly, a description of the method used to determine the straight line on the end side will be omitted.

The points measured by the distance measuring device include not only points on the surface of the pad 2*a*, but also data for points in the groove parts. If the groove parts have an ideal shape, then, since there is a difference in distance between the points in the bottom parts of the grooves and the points on the surface of the pad 2*a*, data for points in the groove parts can be excluded if points at a distance equal to or greater than a specified threshold value are excluded. In actuality, however, since the groove parts have side surfaces that have an inclination, points in the groove parts and points on the surface of the pad 2*a* cannot be distinguished merely by setting a threshold value, so that a special device is required in order to distinguish these points.

Accordingly, in the present working configuration, this problem is solved as follows: first, a preparatory truncation width trw is set in order to extract data used tentatively in calculations. Then, the minimum value among the distance data measured in the effective measurement region is designated as hmin, and the maximum value is designated as hmax.

Then, the preparatory truncation level trunc1 is set on the basis of these sets of data. This is determined as follows:

When ($h$max−$h$min)≦2*trw, then trunc1=($h$max−$h$min)/2

When ($h$max−$h$min)>2*trw, then trunc1=$h$min+trw

Furthermore, among the data in the effective measurement range, the average value of the data in which the distance is equal to or less than the preparatory truncation level trunc1 is determined, and this is designated as "ave." Then, the truncation width trw2 is appropriately set, and the line of regression is determined by performing a regression calculation using data with a distance that is equal to or less than (ave+trw2). This line of regression is designated as follows:

$Z=a1*x+b1$ ($a1$ and $b1$ are constants)

Here, the origin of the x coordinate is taken as the center of the pad 2*a*, and the origin of the z coordinate is set as an appropriately determined value (the same is true below; however, in the following calculations as well, the respective origins are the same as in the present calculations). Furthermore, the standard deviation of this regression is σ1.

Next, the confidence interval coefficient m is appropriately determined, and the truncation width is taken as (m*σ1). Then, regression calculations are again performed using data in which the distance data z is such that $a1*x+b1-m*\sigma1 \leqq z \leqq a1*x+b1+m*\sigma1$ and a line of regression is determined. This line of regression is designated as $z=a2*x+b2$ ($a2$ and $b2$ are constants)

Furthermore, the following truncation width (m*σ2) is determined using this σ2. Then, an operation that again performs regression calculations using data in which the distance data z is such that $a2*x+b2-m*\sigma2 \leqq z \leqq a2*x+b2+m*\sigma2$ is repeated a specified number of times. Alternatively, the system may be devised so that this operation is repeated until the standard deviation of regression is within a specified value range. Moreover, the system may also be devised so that the operation is cut off when either of the conditions is satisfied.

Thus, the line of regression for the front-side surface, i.e., $$Z=a*x+b \text{ (}a\text{ and }b\text{ are constants)}, \quad (1)$$

is determined, and the line of regression for the end-side surface is similarly determined. When both linens of regression are determined, the circular-conical vertical angle of the pad 2*a* is determined from the angle of intersection of these lines. Furthermore, the inclination of the attachment of the pad 2*a* can be determined from the difference between the slope of the line of regression on the front side and the slope of the line of regression on the end side.

Next, the method used to determine the groove depth will be described. The groove depth is also separately determined for the front side and end side; however, since the method of determination is the same in both cases, only the front side will be described.

First, data used to determine the center of gravity used in the calculations is selected. It is desirable that such data used to determine the center of gravity be data in a range that is slightly narrower than the effective measurement range for the x direction. Then, the preparatory truncation width mtrw1 is appropriately determined. Furthermore, where hmax' is the data showing the maximum distance data among the data for determining the center of gravity used in the calculations, the preparatory truncation level mtrunc1 is determined as follows:

mtrunc1=$h$max'−mtrw1

The preparatory truncation width mtrw1 is determined so that data in the vicinity of the surface is excluded as far as possible from the distance data equal to or greater than the preparatory truncation level mtrunc1.

Furthermore, the average value of the distance data among the data used to determine the center of gravity in which the distance is greater than the preparatory truncation level mtrunc1 is determined, and this is designated as mave.

Next, the groove part region truncation level mtrunc2 is appropriately determined. Then, the center of gravity (X, Z) is determined for data having a distance equal to or greater than (mave−mtrunc2). The groove part region truncation level mtrunc2 is determined so that data in the vicinity of the surface is excluded as far as possible from data having a distance equal to or greater than (mave−mtrunc2).

Meanwhile, for all of the measurement data, a regression analysis is performed so that the data fits a straight line which is such that z=c*x+d (c and d are coefficients), the values of c and d are determined, and, utilizing only the slope c among these, the following is taken as a straight line indicating the bottom surfaces of the grooves:

$$z=c(x-X)+Z \quad (2)$$

Then, the center value $X_M$ between data showing the maximum value and data showing the minimum value in the x direction among the data used to determine the center of gravity is determined, and the distance in the z direction between equation (1) indicating the surface and equation (2) indicating the bottom surfaces of the grooves in the position where x is $X_M$ is taken as the groove depth. Specifically, groove depth=$(c-a)X_M-cX+(Z-b)$ Furthermore, with the inclination of the straight line expressing the bottom surfaces of the grooves taken as c, a in equation (1) can also be used. In this case, the groove depth is indicated as follows:

groove depth=$-aX+(Z-b)$

The above calculations are performed for the front side and end side, and the average of both is taken as the final groove depth.

Next, the method used to determine the pad thickness will be described. First, for the front side and end side, the pad surface position at the center in the X direction of the effective region of measurement for the surface is determined from equation (1), and this is averaged for the front side and end side (added and divided by 2). The resulting value is taken as the pad center surface position. Meanwhile, as is shown in FIG. 11, there is an internal part consisting of the hole 2*b* in the center of the polishing pad 2. Accordingly, the distance to the bottom surface of this part is determined, and the difference between this distance and the distance to the pad center surface position in the z direction is taken as the pad thickness.

Below, the temperature correction of the circular-conical vertical angle will be described. When there is a variation in temperature, the guide 8 shows a conspicuous variation due to the bimetal effect. As a result, movement of the movable element 9 corresponding to pitching and rolling fluctuation is induced. Accordingly, as was described above, a method is also used in which pitching and rolling of the movable element 9 are detected, and a distance correction is made; in the present working configuration, however, the temperature of the guiding and holding plate 7 is detected in addition to this, and a correction of the measured circular-conical vertical angle is also performed accordingly.

Specifically, as is shown in FIG. 1, a temperature sensor 22 is attached to the vicinity of the central part of the guiding and holding plate 7, the signal from this sensor is taken into the control board 24, and the circular-conical vertical angle is corrected. As an advance preparation, a table of circular-conical vertical angles measured at respective temperatures is prepared in the control board 24 or control device 23. In order to prepare this table, the measuring device as a whole is placed in a thermostat or the like, and the temperature is varied while performing temperature control. Then, measurement of the circular-conical vertical angle is performed for the pad-form reference plane at each specified temperature. The pad-form reference plane is substantially flat, and has a concavo-convexity of 0. A table showing the relationship between the temperature and the circular-conical vertical angle can be prepared by this operation.

In cases where this measuring device is mounted in a CMP apparatus, the measurement of the polishing pad is performed by the previously described sequence from step 3 to step 7. In this case, the control board 24 constantly obtains the output value of the temperature sensor 22. The control board 24 reads the correction value of the circular-conical vertical angle corresponding to the temperature at the time of measurement from the table, and adds or subtracts the correction amount to or from the measured value. As a result, even if there is a temperature fluctuation, the circular-conical vertical angle of the polishing pad can be measured with good precision. The circular-conical vertical angle may also use a supplementary angle or concavo-convex displacement table.

Figure 12:
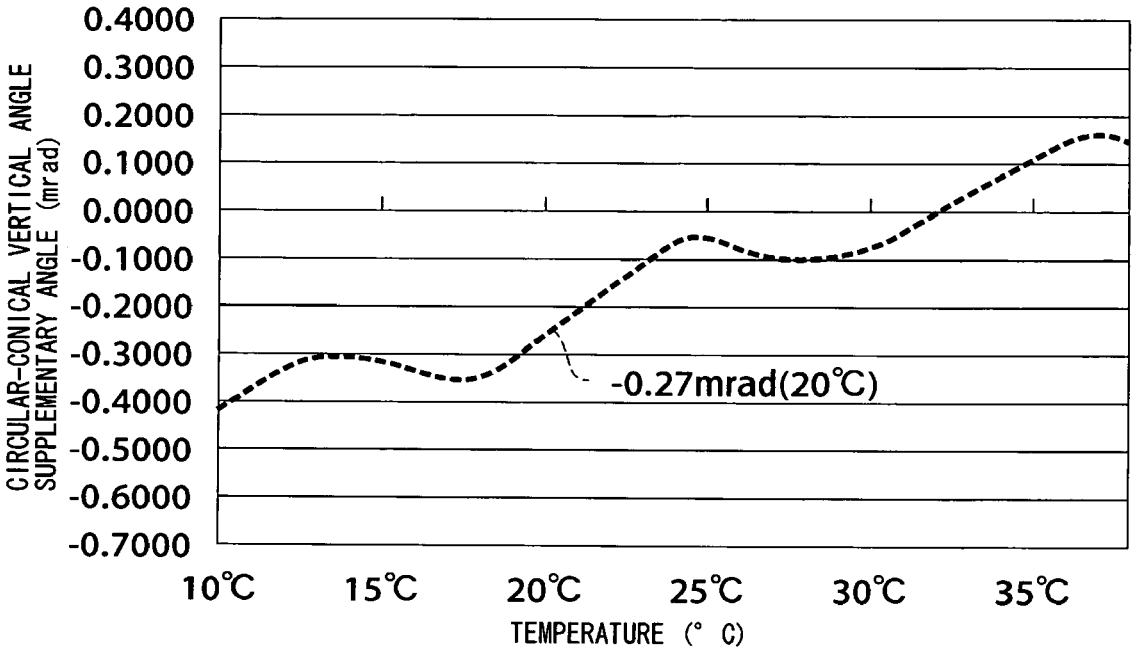
FIG. 12 is a diagram showing an example of a temperature table using the circular-conical vertical angle.

FIG. 12 shows an example of a temperature table using the circular-conical vertical angle supplementary angle as a graph. For example, the correction value in the case of 20° C. is −0.27 mrad. Assuming that the value measured with the polishing pad at 20° C. is 0.1 mrad, then 0.1−(−0.27)=0.37 mrad is the intrinsic circular-conical vertical angle supplementary angle.

Furthermore, in the above description, measurements were performed along a straight line passing through the vicinity of the center of the pad 2*a*. However, as was described above, in cases where a device in which an arm that supports a sensor part is caused to rotate about a certain axis of rotation is used as the distance measuring device, the line indicating the relationship between the angle of rotation and the measured distance is not a straight line, but rather a curved line indicated by the intersecting line between the circular-conical surface indicating the pad surface and the cylindrical surface expressing the curved surface of rotation of the sensor. Among these, the cylindrical surface expressing the curved surface of rotation of the sensor is determined by the measuring device; accordingly, the circular-conical surface indicating the pad surface is assumed, and the curved line indicating the line of intersection of these surfaces is assumed. Then, the coefficient of this curved line is determined by regression calculations on the basis of the measured data, and the circular-conical vertical angle is determined from this. As the procedure used in the regression calculations in this case, a method in which regression calculations are repeated in a stepwise manner is used, just as in the procedure used in the linear regression described above.

Figure 13:
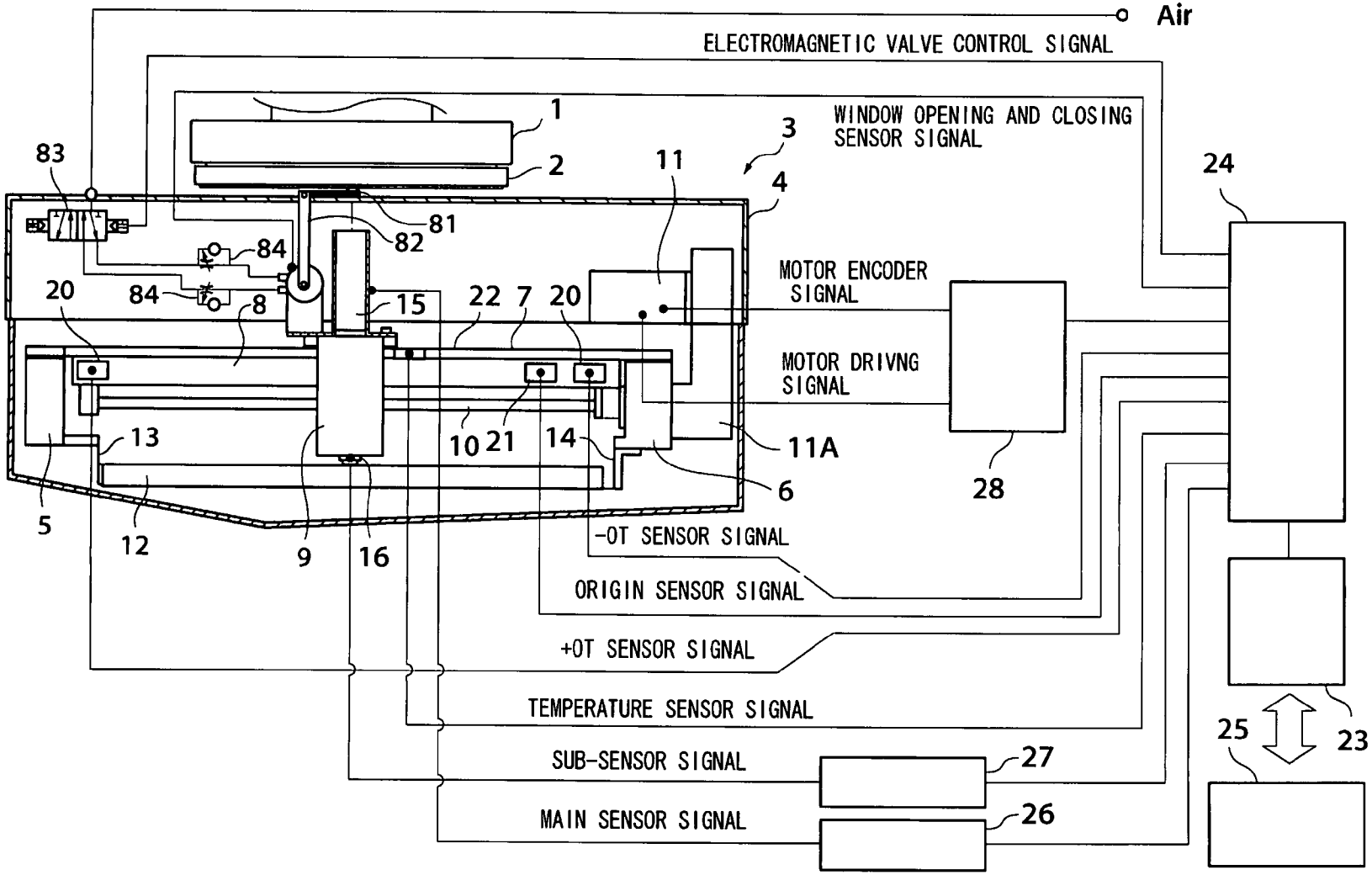
FIG. 13 is an overall schematic diagram showing the construction of a polishing pad surface shape measuring device constituting a fifth example of a working configuration of the present invention.

FIG. 13 is an overall schematic diagram showing the construction of a polishing pad surface shape measuring device constituting a fifth example of a working configuration of the present invention. This figure corresponds to FIG. 1. Here, the polishing pad surface shape measuring device shown in FIG. 13 also has an air cylinder 17 used to open and close the window, an electromagnetic valve 18 and a speed controller 19; however, these constituent elements are omitted from the figure due to considerations of graphic illustration.

The only difference between the working configuration shown in FIG. 1 and the working configuration shown in FIG. 13 is as follows: namely, in the working configuration shown in FIG. 13, a measuring element 81, a measuring element driving mechanism 82, a measuring element driving electromagnetic valve 83 and a speed controller 84 are provided. In the working configuration shown in FIG. 13, all of the constituent elements shown in FIG. 1 are required, and the actions of these constituent elements are the same as in the working configuration shown in FIG. 1. Accordingly, a description of these constituent elements is omitted.

Figure 14:
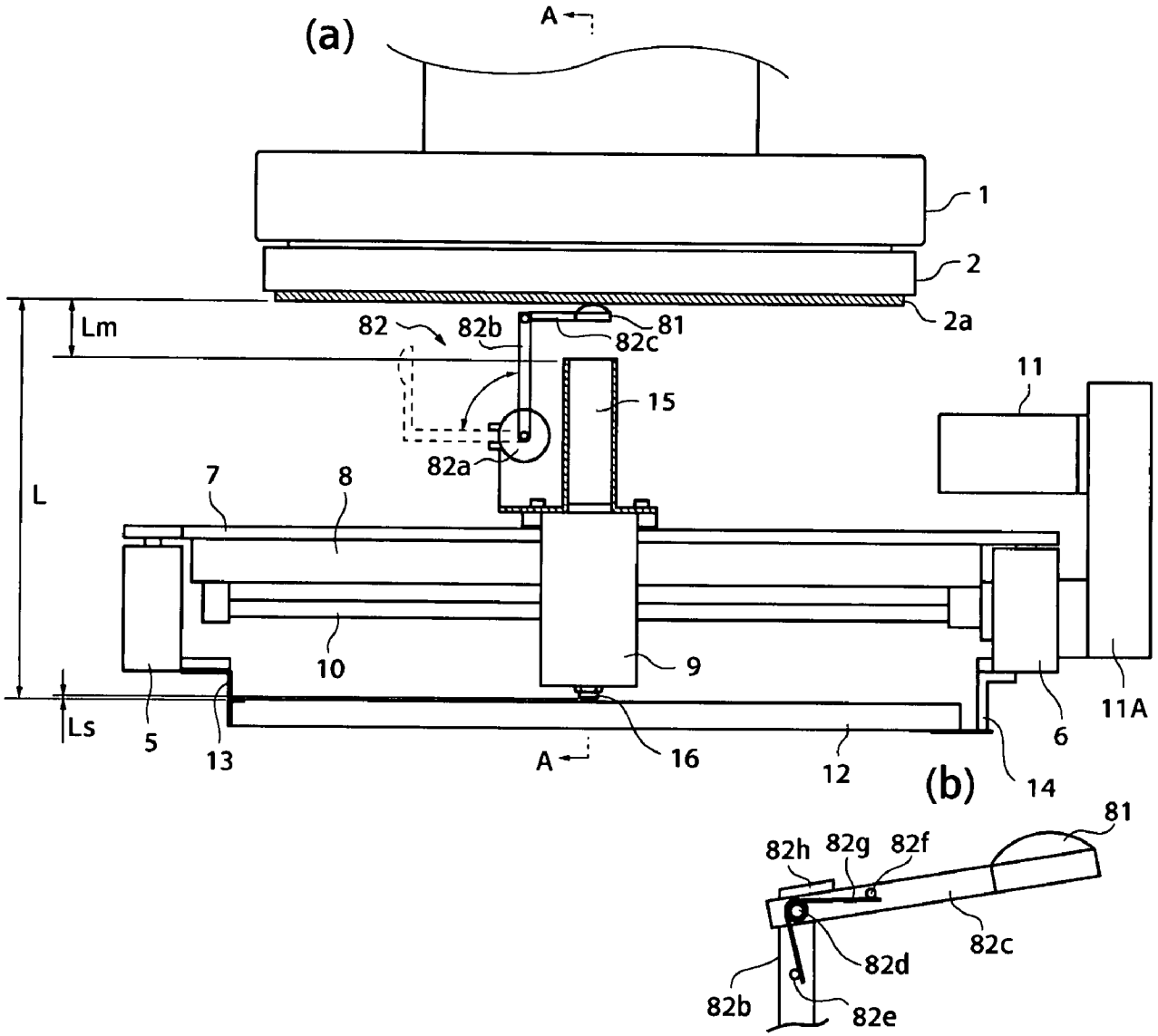
FIG. 14 is a detailed diagram of the essential parts of the main body part 3 of the polishing pad surface shape measuring device shown in FIG. 13.

FIG. 14 is a detailed diagram of the essential parts of the polishing pad surface shape measuring device main body part 3 shown in FIG. 13. This diagram corresponds to FIG. 2. In FIG. 14(*a*), the measuring element driving mechanism 82 has an air pressure rotary actuator 82*a*, a first link member 82*b*, and a second link member 82*c*.

By the switching of the measuring element driving electromagnetic valve 83 shown in FIG. 13, the air pressure rotary actuator 82*a* causes the rotation of the first link member 82*b* and the members attached to this first link member 82*b*, thus positioning these members in either the position indicated by a solid line or the position indicated by a broken line in FIG. 14(*a*). The first link member 82*b* and second link member 82*c* are connected by the link mechanism shown in FIG. 14(*b*), and the measuring element 81 is attached to the tip end part of the second link member 82*c*.

As is seen by reference to FIG. 14(*b*), the first link member 82*b* and second link member 82*c* are connected to each other by a pivoting pin 82*d* so that these link members can pivot. Furthermore, a spring 82*g* is wound on the pivoting pin 82*d*, and both end parts of this spring are caused to contact protruding parts 82*e* and 82*f* so that the parts are driven by the driving force of the spring 82*g* in the direction that causes an angle to open between the first link member 82*b* and second link member 82*c* (i.e., in the direction in which the second link member 82*c* moves in the counter-clockwise direction in the figures). However, a stopper 82*h* is attached to the tip end part of the first link member 82*b* so that the angle between the first link member 82*b* and the second link member 82*c* does not open too far.

When the first link member 82*b* pivots from the position indicated by the broken line to the position indicated by the solid line as a result of the switching of the measuring element driving electromagnetic valve 83, the upper surface of the measuring element 81 contacts the pad 2*a*. When the movable element 9 is caused to move in the left-right direction (in the figures) in this state, the measuring element

81 slides along the surface of the pad 2*a*. The driving force of the spring 82*g* is set as a force which is sufficient to cause the measuring element 81 to contact the surface of the pad 2*a*, and to crush the nap that is formed on the surface of the pad 2*a*, but which is such that no great deformation of the pad 2*a* itself is caused by the pressing force.

The constituent elements shown in FIG. 14 other than the parts described above are the same as those shown in FIG. 2, and the effects are also the same as those of the parts shown in FIG. 2; accordingly, a description is omitted.

Figure 15:
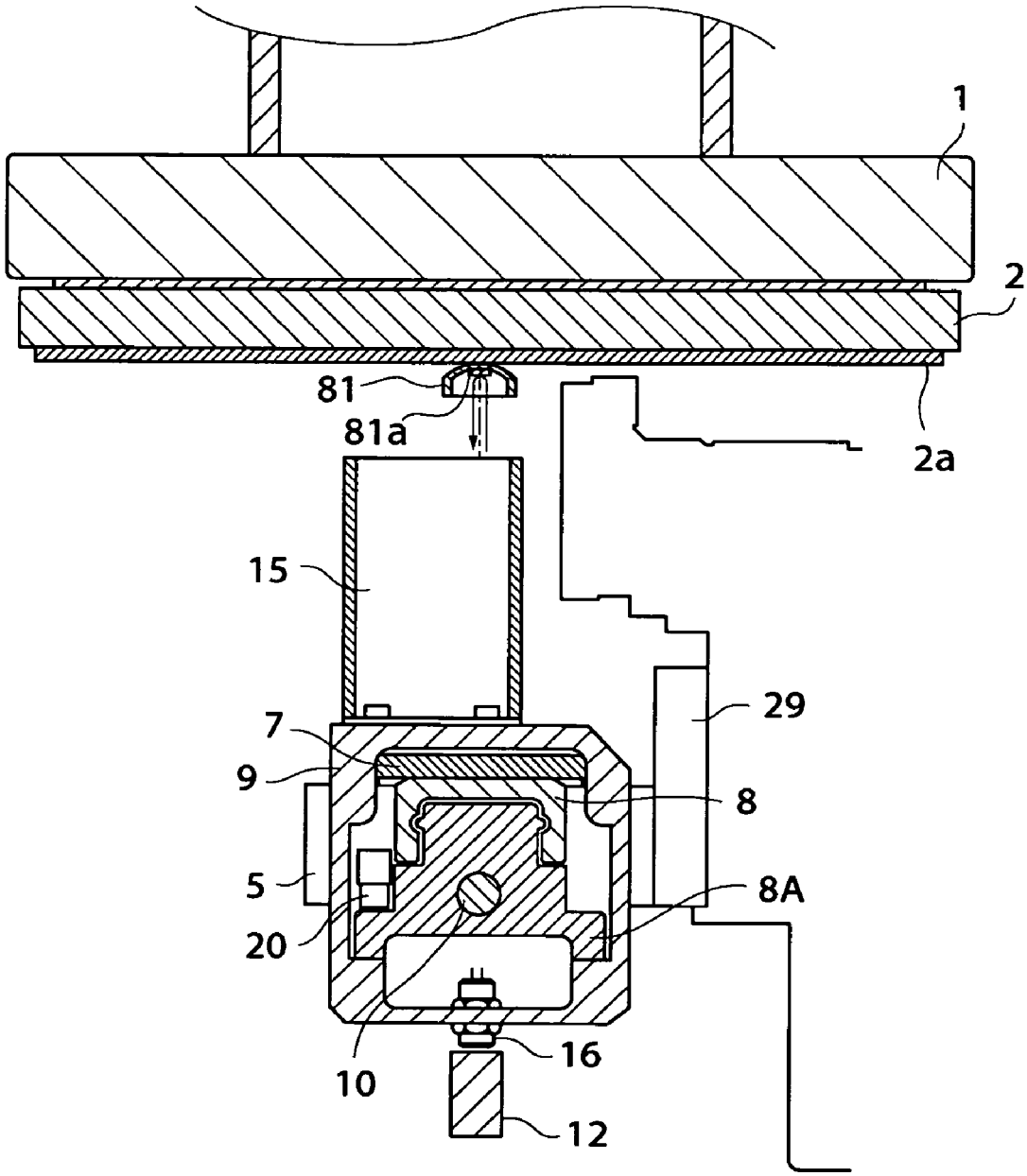
FIG. 15 is a diagram, corresponding to FIG. 3, of the working configuration shown in FIG. 13.

FIG. 15 is a diagram, corresponding to FIG. 3, of the working configuration shown in FIG. 13. In this figure, the measuring element 81 is in a position contacting the pad 2*a*. A reflective plate 81*a* is attached to the back side of the measuring element 81. The reflective plate 81*a* may have a mirror-form reflective surface, or may conversely have a reflective surface that diffuses light. Furthermore, the reflective plate 81*a* may also be the same member as the measuring element 81. In this state, the main sensor 15 measures the distance to the reflective plate 81*a*. Specifically, when the first link member 82*b*, the second link member 82*c* that is attached to this first link member 82*b*, and the measuring element 81 are in the position indicated by the broken line in FIG. 14, the main sensor 15 measures the distance to the surface of the polishing pad 2 (i.e., the surface of the pad 2*a*), and when the first link member 82*b*, the second link member 82*c* that is attached to this first link member 82*b*, and the measuring element 81 are in the position indicated by the solid line, the main sensor 15 measures the distance to the reflective plate 81*a* as shown in FIG. 15.

The object that is measured is switched by the measuring element driving electromagnetic valve 83. Below, cases in which the main sensor 15 measures the distance to the surface of the polishing pad 2 will be called non-contact measurement, and cases in which the main sensor 15 measures the distance to the reflective plate 81*a*, and thus indirectly measures the distance to the surface of the polishing pad 2, will be called contact measurement.

Figure 16:
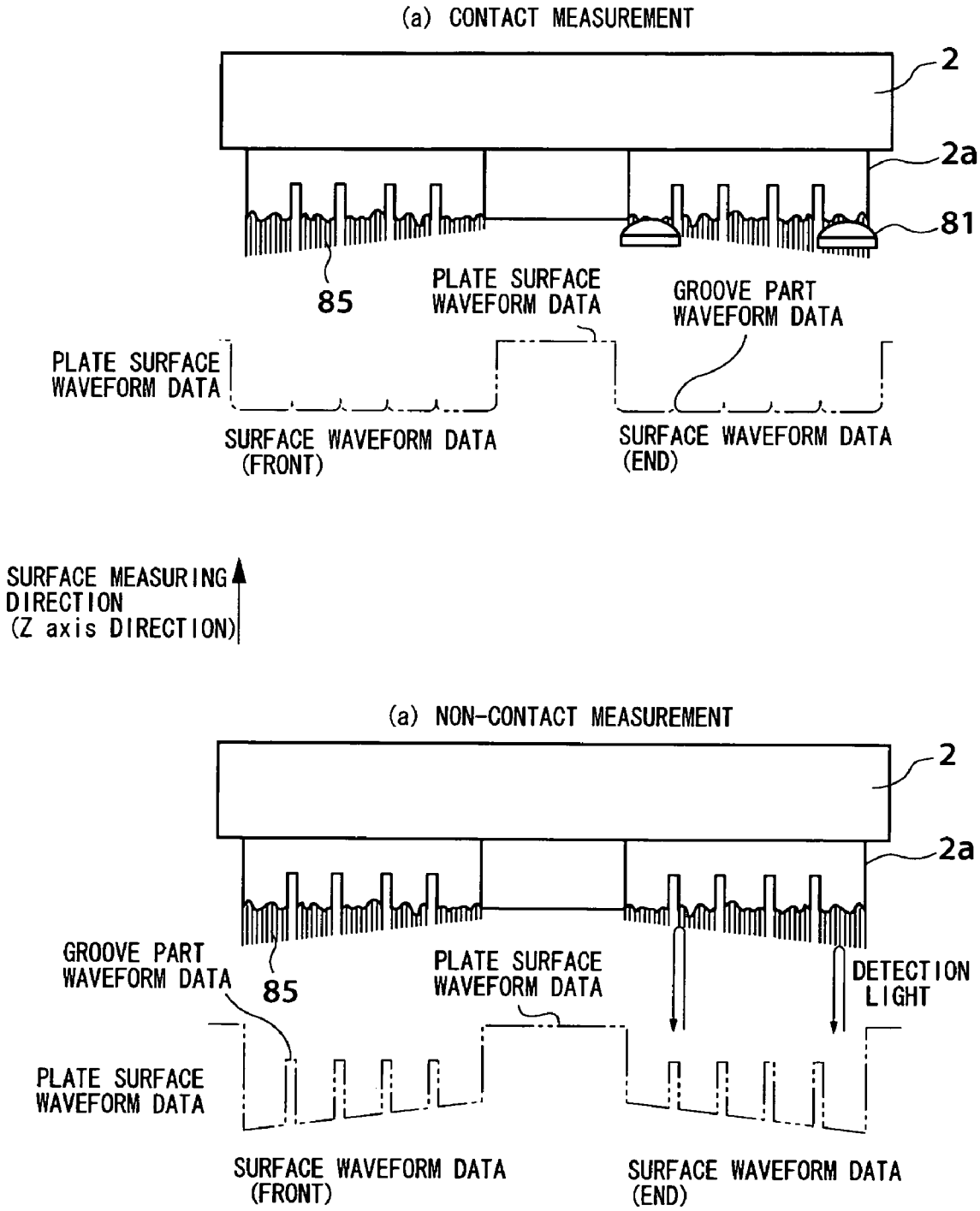
FIG. 16 is a diagram showing a comparison of contact measurement and non-contact measurement.

FIG. 16 shows a comparison of contact measurement and non-contact measurement. In the case of contact measurement, as is shown in FIG. 16(*a*), even in cases where nap 85 is present on the surface of the pad 2*a*, this nap is crushed by the measuring element 81; accordingly, the surface shape of the pad 2*a* can be measured without being affected by this nap 85. On the other hand, since the measuring element 81 cannot enter the groove parts, the groove depth cannot be measured.

In the case of non-contact measurement, as is shown in FIG. 16(*b*), the groove depth can be measured; however, there may be cases in which the measurement is affected by nap 85 on the surface, so that the surface shape of the pad 2*a* cannot be accurately measured.

Thus, contact measurement and non-contact measurement have advantages and disadvantages. Accordingly, it is desirable that these two types of measurement be used in accordance with the object of measurement and the conditions of nap 85 on the surface of the pad 2*a*. Specifically, in cases where there is little nap 85, so that it would appear to be possible to achieve sufficient measurement of the surface state of the pad 2*a* even by non-contact measurement, all of the measurements can be performed by non-contact measurement alone.

In cases where the conditions of nap 58 are such that there is a danger of error in non-contact measurement, only the measurement of the surface shape of the pad 2*a* is performed by contact measurement, and the circular-conical vertical angle and pad thickness are measured on the basis of this data. In cases where the groove depth is measured, the positions of the bottom surfaces of the grooves may be measured by non-contact measurement, and the groove depth may be calculated from this data and the data for the surface shape of the pad 2*a* measured by contact measurement.

The sequence whereby the circular-conical vertical angle and pad thickness are calculated by contact measurement is the same as in the method described above as steps 1 through 8. In this method, the groove depth is also simultaneously calculated; however, since these calculated results lack reliability, the calculated groove depth is not used.

Figure 17:
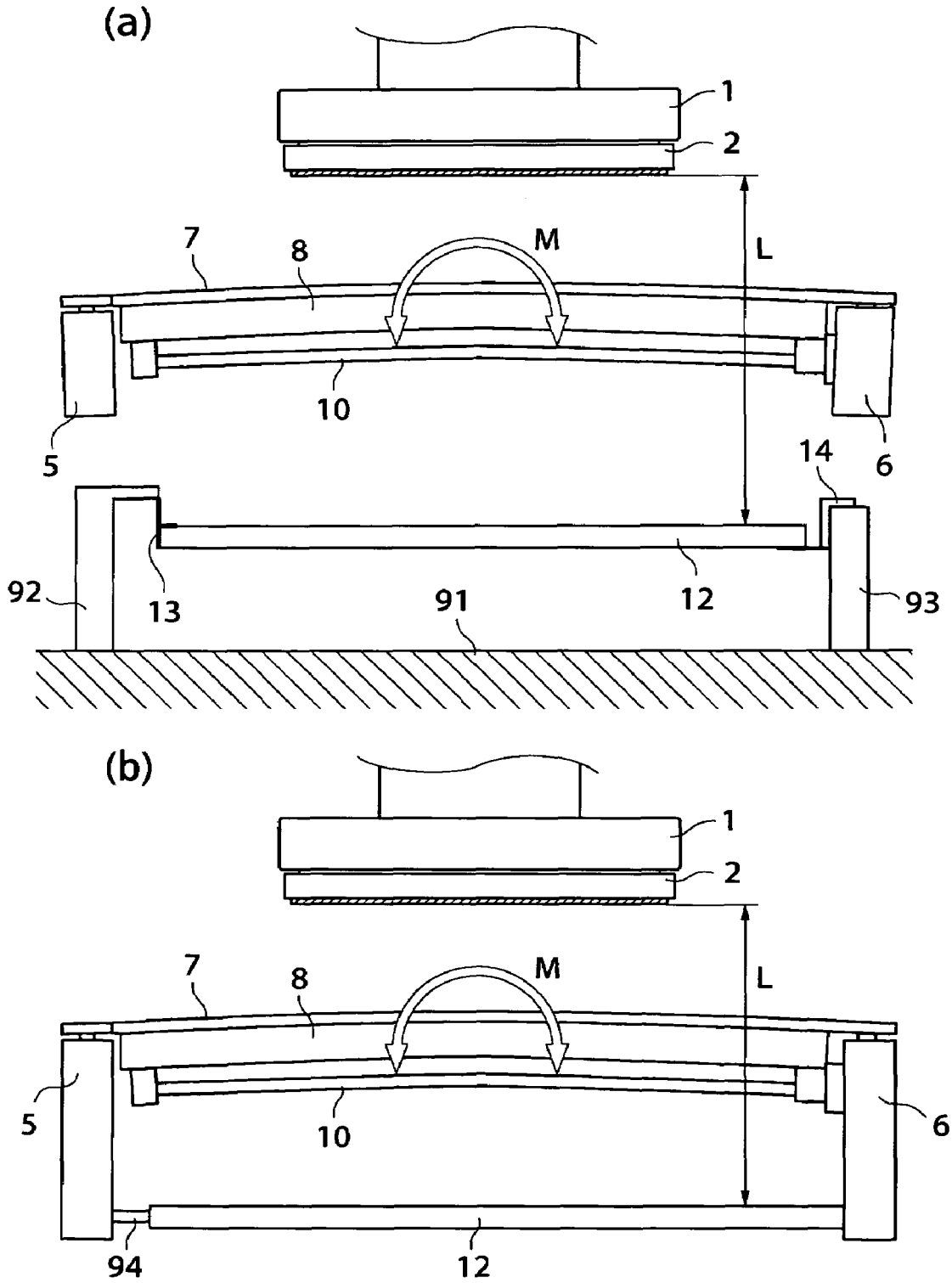
FIG. 17 is diagram showing a modified example of the supporting method of the reference block 12.
Figure 18:
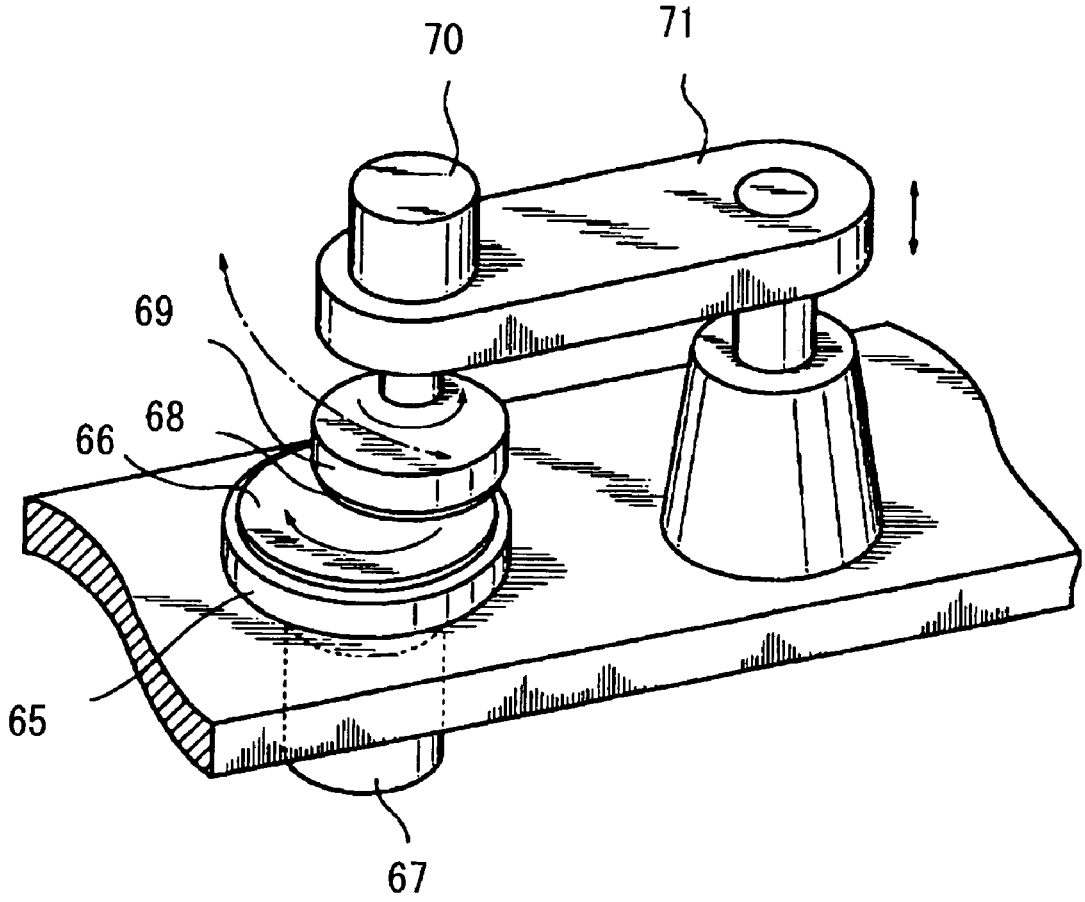
FIG. 18 is a diagram showing an outline of a conventional CMP polishing apparatus.
Figure 19:
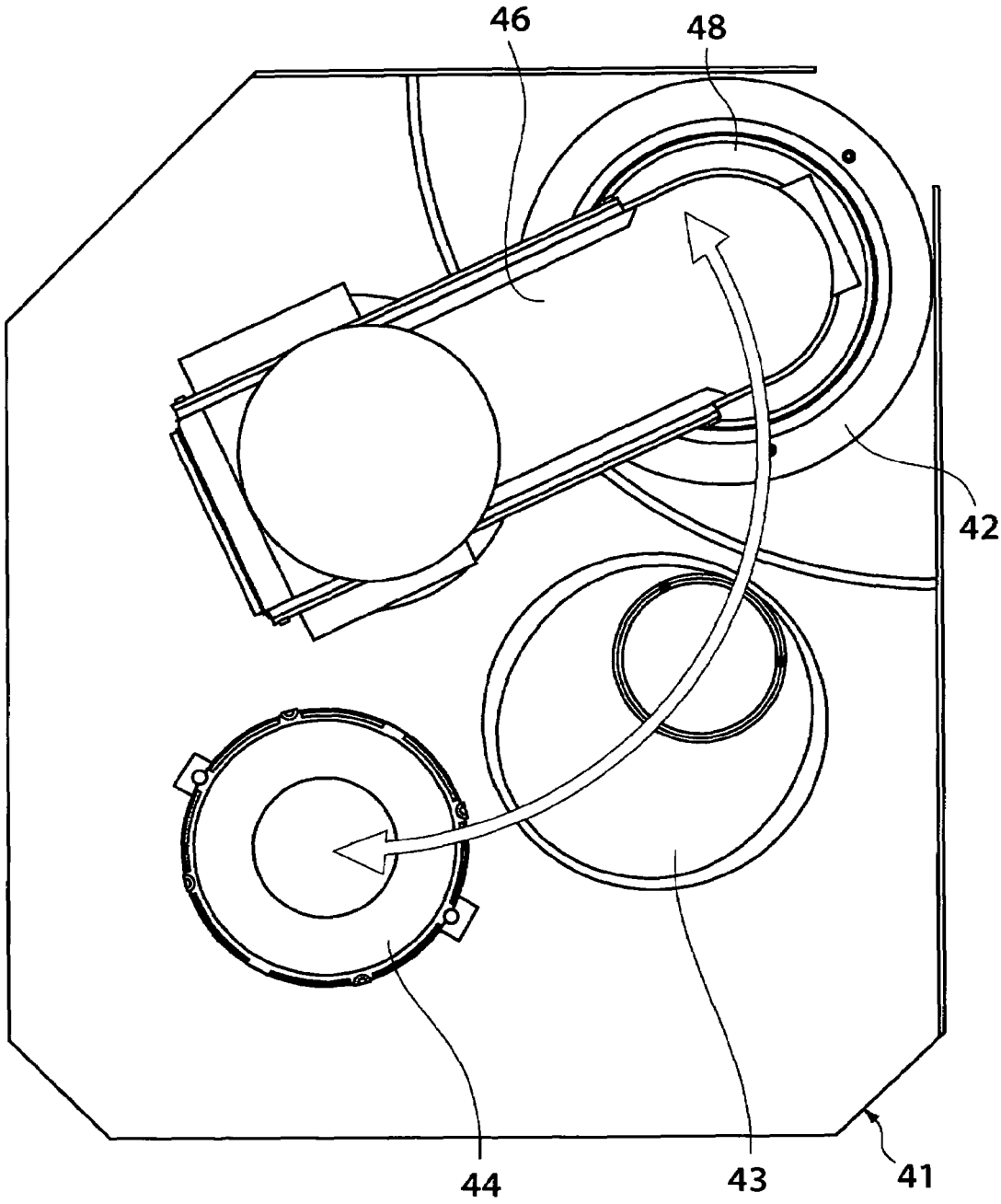
FIG. 19 is a diagram showing the internal construction of the polishing chamber of the CMP polishing apparatus.

Below, a modified example of the method used to support the reference block 12 will be described using FIG. 17. In FIG. 4, the reference block 12 was supported on the front block 5 and rear block 6 by a first holding member 13 and a second holding member 14, respectively. However, as is shown in FIG. 17(*a*), it would be possible not only to use such a method, but also to install supporting parts 92 and 93 on a platen 91 serving as a reference, and to attach the first holding member 13 to the supporting part 92, and to attach the second holding member 14 to the supporting part 93. In this way as well, it is possible to prevent deformation of the guide 8 from causing fluctuations in the position of the reference block 12.

In addition, as is shown in FIG. 17(*b*), it would also be possible to prevent deformation of the guide 8 from causing fluctuations in the position of the reference block 12 by attaching the reference block 12 directly to the rear block 6, and attaching the reference block 12 to the front block 5 via an elastic body 94. Naturally, furthermore, the reference block 12 may also be attached to the rear block 6 via an elastic body.

The invention claimed is:

1. A polishing pad surface shape measuring device comprising a first detector which measures the distance to the surface of the polishing pad, a second detector which measures the distance to the surface of a reference member that has a standard degree of flatness, a movable element which slides along a guide mechanism, and which carries the first detector and the second detector, a driving part which drives the movable element in the direction of diameter of the polishing pad, position detection means for detecting the position of the movable element in the direction of diameter of the polishing pad, and measurement means for measuring at least one value selected from a set consisting of the circular-conical vertical angle formed by the polishing pad surface, the groove depth and the pad thickness, using the distance output from the first detector, the distance output from the second detector and the output of the position of the movable element in the direction of diameter of the polishing pad, wherein at least one end of the reference member is held by a mechanism that allows displacement of the movable element in the driving direction and bending in this direction.

2. The polishing pad surface shape measuring device according to claim 1, wherein the device has a waterproof cover that accommodates at least the first detector, the second detector, the reference member, the guide mechanism, the movable element, a portion of the driving part, and the position detection means, a window part that is used to observe the polishing pad is formed in this waterproof cover, and a mechanism for opening and closing this window part is provided.

3. The polishing pad surface shape measuring device according to claim 1, wherein the first detector is an optical distance detector.

4. The polishing pad surface shape measuring device according to claim 1, wherein the system has a device that blows a gas over the measurement location on the surface of the polishing pad during measurement.

5. The polishing pad surface shape measuring device according to claim 1, wherein the system has an inclination detector that detects the inclination of the movable element with respect to the reference member, and the measurement means has the function of correcting the distance output from the first detector and the distance output from the second detector using the output from the inclination detector.

6. The polishing pad surface shape measuring device according to claim 1, wherein the system has a temperature detector for the guide mechanism, and the measurement means has the function of correcting the measured value of the circular-conical vertical angle using the output of this temperature detector.

7. The polishing pad surface shape measuring device according to claim 1, wherein the reference member is held by this polishing pad surface shape measuring device, with one end being held by an elastic body that allows displacement with one degree of freedom, and the other end being held by an elastic body that allows displacement with two degrees of freedom, thus reducing the elongation of the reference member in the driving direction of the movable element and the bending retention rigidity in this direction.

8. A method of use for a polishing pad surface shape measuring device, wherein a plurality of circular-conical vertical angles are determined using the polishing pad surface shape measuring device according to any one of claims 1, 2, 3, 4, 5, 6, and 7 by rotating the polishing pad and performing measurements in respective rotational positions, and the dressing position of the polishing pad is determined on the basis of a value obtained by the statistical processing of these measured angles.

9. A method of use for a polishing pad surface shape measuring device, wherein a plurality of values for the groove depths are determined using the polishing pad surface shape measuring device according to any one of claims 1, 2, 3, 4, 5, 6, and 7 by rotating the polishing pad and performing measurements in respective rotational positions, and replacement of the polishing pad is performed on the basis of a value determined by the statistical processing of these measured values.

10. A method of use for a polishing pad surface shape measuring device, wherein a plurality of values for the polishing pad thicknesses are measured using the polishing pad surface shape measuring device according to any one of claims 1, 2, 3, 4, 5, 6, and 7 by rotating the polishing pad and performing measurements in respective rotational positions, and replacement of the conditioner of the dressing device is performed on the basis of a value obtained by the statistical processing of these polishing pad thickness values.

11. A CMP polishing apparatus, wherein the polishing pad surface shape measuring device according to any one of claims 1, 2, 3, 4, 5, 6, and 7 is built into the apparatus.

12. A semiconductor device manufacturing method, wherein this method has a step in which the surfaces of semiconductor wafers are flattened using the CMP polishing apparatus according to claim 11.

* * * * *